US009229342B2

(12) United States Patent
Anezaki et al.

(10) Patent No.: US 9,229,342 B2
(45) Date of Patent: Jan. 5, 2016

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Takashi Anezaki, Hiratsuka (JP); Kazuhisa Shida, Kawasaki (JP); Masashi Nishi, Susono (JP); Hirofumi Kumoi, Suntou-gun (JP); Daisuke Tanaka, Yokohama (JP); Kazumichi Sugiyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 42 days.

(21) Appl. No.: 14/077,526

(22) Filed: Nov. 12, 2013

(65) Prior Publication Data

US 2014/0134525 A1 May 15, 2014

(30) Foreign Application Priority Data

Nov. 14, 2012 (JP) ..... 2012-250513
Oct. 11, 2013 (JP) ..... 2013-214108

(51) Int. Cl.
*G03G 5/04* (2006.01)
*G03G 5/07* (2006.01)
*G03G 21/18* (2006.01)
(Continued)

(52) U.S. Cl.
CPC ..... *G03G 5/078* (2013.01); *G03G 5/051* (2013.01); *G03G 5/056* (2013.01); *G03G 5/0514* (2013.01); *G03G 5/0517* (2013.01); *G03G 5/0564* (2013.01); *G03G 5/0571* (2013.01); *G03G 5/0578* (2013.01); *G03G 5/14708* (2013.01); *G03G 5/14752* (2013.01);
(Continued)

(58) Field of Classification Search
CPC . G03G 5/0514; G03G 5/0564; G03G 5/0578; G03G 5/0589; G03G 5/0592; G03G 5/14756; G03G 5/14773; G03G 5/14786; G03G 5/14791
See application file for complete search history.

(56) References Cited

U.S. PATENT DOCUMENTS

2003/0190540 A1* 10/2003 Shoshi et al. ..... 430/78
2009/0257777 A1* 10/2009 Kanazawa et al. ..... 399/159
(Continued)

FOREIGN PATENT DOCUMENTS

EP 2306248 A1 4/2011
JP 05043670 A 2/1993
(Continued)

OTHER PUBLICATIONS

Translation of JP 2002-182406 published Jun. 2002.*

*Primary Examiner* — Peter Vajda
(74) *Attorney, Agent, or Firm* — Canon U.S.A. Inc., IP Division

(57) ABSTRACT

A surface layer of an electrophotographic photosensitive member contains (α) a particular siloxane-modified resin, (β) a particular compound, and a charge transporting substance. (β) is at least one compound selected from the group consisting of hexanol, heptanol, cyclohexanol, benzyl alcohol, ethylene glycol, 1,4-butanediol, 1,5-pentanediol, diethylene glycol, diethylene glycol ethyl methyl ether, ethylene carbonate, propylene carbonate, nitrobenzene, pyrrolidone, N-methylpyrrolidone, methyl benzoate, ethyl benzoate, benzyl acetate, ethyl 3-ethoxypropionate, acetophenone, methyl salicylate, dimethyl phthalate, and sulfolane.

9 Claims, 4 Drawing Sheets

(51) Int. Cl.
*G03G 5/05* (2006.01)
*G03G 5/147* (2006.01)

(52) U.S. Cl.
CPC ..... *G03G 5/14756* (2013.01); *G03G 5/14765* (2013.01); *G03G 5/14773* (2013.01); *G03G 21/18* (2013.01)

(56) References Cited

U.S. PATENT DOCUMENTS

| | | | | |
|---|---|---|---|---|
| 2011/0053069 | A1 * | 3/2011 | Yu et al. | 430/59.6 |
| 2011/0177438 | A1 | 7/2011 | Noguchi | |

FOREIGN PATENT DOCUMENTS

| | | | | | |
|---|---|---|---|---|---|
| JP | 05158249 | A | | 6/1993 | |
| JP | 08234468 | A | | 9/1996 | |
| JP | 10182832 | A | | 7/1998 | |
| JP | 2002-182406 | | * | 6/2002 | G03G 5/05 |
| JP | 2004070269 | A | | 3/2004 | |
| JP | 2006084578 | A | | 3/2006 | |
| JP | 2006328416 | A | | 12/2006 | |
| JP | 2007079555 | A | | 3/2007 | |
| JP | 2008195905 | A | | 8/2008 | |
| JP | 200984556 | A | | 4/2009 | |
| WO | 2011-071093 | A1 | | 6/2011 | |
| WO | 2012-035944 | A1 | | 3/2012 | |
| WO | 2012-074082 | A1 | | 6/2012 | |

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, a process cartridge, and an electrophotographic apparatus.

2. Description of the Related Art

Electrophotographic photosensitive members for use in electrophotographic apparatuses often contain an organic photoconductive substance (a charge generating substance). While an electrophotographic apparatus forms images, electrical and mechanical external forces, such as those utilized in charging, exposure, development, transfer, and cleaning, are directly applied to an electrophotographic photosensitive member of the electrophotographic apparatus. Thus, the electrophotographic photosensitive member must be resistant to such electrical and mechanical external forces. The electrophotographic photosensitive member also should have a surface that can reduce friction (increase lubricity) against a contact member (such as a cleaning blade).

In order to increase lubricity, Japanese Patent Laid-Open No. 2008-195905 and No. 2006-328416 propose a method for introducing a particular siloxane-modified polycarbonate resin (having a siloxane structure) into a surface layer of an electrophotographic photosensitive member. Japanese Patent Laid-Open No. 2009-84556 proposes a method for introducing a particular siloxane-modified polyester resin into a surface layer.

As a result of investigations, however, the present inventors found that a siloxane material and a charge transporting substance in a surface layer of an electrophotographic photosensitive member tend to induce ghosts. More specifically, a portion of an output image irradiated with light during prerotation tends to have a high density (a positive ghost).

When a particular siloxane-modified polycarbonate resin or siloxane-modified polyester resin disclosed in Japanese Patent Laid-Open No. 2008-195905, No. 2006-328416, and No. 2009-84556 is used, there is room for improvement in reducing occurrence of ghost images during repeated use of an electrophotographic photosensitive member.

SUMMARY OF THE INVENTION

The present invention provides an electrophotographic photosensitive member containing a particular siloxane-modified resin that can reduce an initial friction force (initial friction coefficient) and occurrence of ghost images during repeated use of the electrophotographic photosensitive member. The present invention also provides a process cartridge and an electrophotographic apparatus each including the electrophotographic photosensitive member.

The present invention provides such an electrophotographic photosensitive member, a process cartridge, and an electrophotographic apparatus.

The present invention relates to an electrophotographic photosensitive member that includes a support, a charge generating layer formed on the support, and a charge transporting layer formed on the charge generating layer. The electrophotographic photosensitive member includes a surface layer that contains the following (α) and (β) and a charge transporting substance.

(α) A siloxane-modified resin having a structural unit represented by any one of the following formulae (A), (B), (C), and (D).

(β) At least one compound selected from the group consisting of hexanol, heptanol, cyclohexanol, benzyl alcohol, ethylene glycol, 1,4-butanediol, 1,5-pentanediol, diethylene glycol, diethylene glycol ethyl methyl ether, ethylene carbonate, propylene carbonate, nitrobenzene, pyrrolidone, N-methylpyrrolidone, methyl benzoate, ethyl benzoate, benzyl acetate, ethyl 3-ethoxypropionate, acetophenone, methyl salicylate, dimethyl phthalate, and sulfolane.

(A)

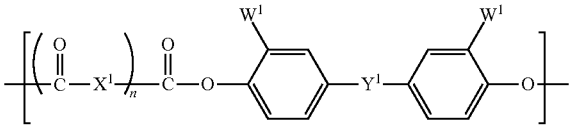

In the formula (A), $Y^1$ represents a single bond, a methylene group, an ethylidene group, a propylidene group, a phenylethylidene group, a cyclohexylidene group, or an oxygen atom, $X^1$ represents a meta-phenylene group, a para-phenylene group, or a bivalent group having two para-phenylene groups bonded with an oxygen atom, n represents 0 or 1, and $W^1$ represents a univalent group represented by the following formula (W1) or (W2).

(W1)

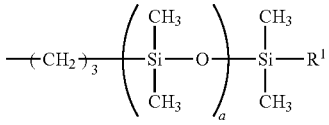

(W2)

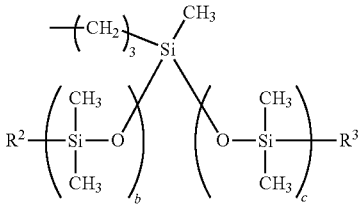

In the formulae (W1) and (W2), $R^1$ to $R^3$ each independently represents an alkyl group having 1 to 4 carbon atoms, "a" represents the number of repetitions of a structure in parentheses, and "b" and "c" each independently represents the number of repetitions of a structure in parentheses, the average of "a" in the siloxane-modified resin having a structural unit represented by the formula (A) ranges from 10 to 150, and the average of b+c in the siloxane-modified resin having the structural unit represented by the formula (A) ranges from 10 to 150.

(B)

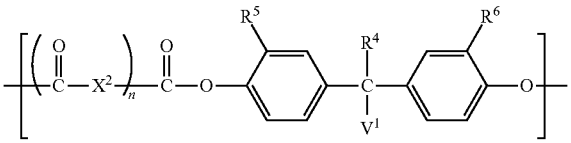

In the formula (B), $X^2$ represents a meta-phenylene group, a para-phenylene group, or a bivalent group having two para-phenylene groups bonded with an oxygen atom, n represents 0 or 1, $R^4$ to $R^6$ each independently represents a hydrogen atom, an alkyl group having 1 to 4 carbon atoms, or a phenyl group, and $V^1$ represents a univalent group represented by the following formula (V1) or (V2).

(V1)

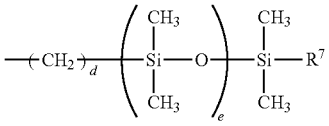

(V2)

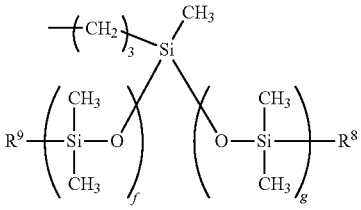

In the formulae (V1) and (V2), $R^7$ to $R^9$ each independently represents an alkyl group having 1 to 4 carbon atoms, "d" represents the number of repetitions of a structure in parentheses and ranges from 2 to 10, "e" represents the number of repetitions of a structure in parentheses, and "f" and "g" each independently represents the number of repetitions of a structure in parentheses, and the average of "e" in the siloxane-modified resin having a structural unit represented by the formula (B) ranges from 10 to 150, and the average of f+g in the siloxane-modified resin having the structural unit represented by the formula (B) ranges from 10 to 150.

(C)

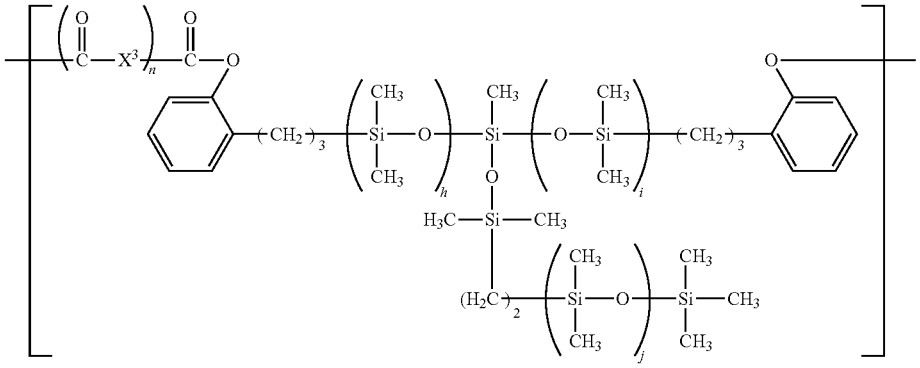

In the formula (C), $X^3$ represents a meta-phenylene group, a para-phenylene group, or a bivalent group having two para-phenylene groups bonded with an oxygen atom, n represents 0 or 1, "h", "i", and "j" each independently represents the number of repetitions of a structure in parentheses, the average of "h" and the average of "i" in the siloxane-modified resin having a structural unit represented by the formula (C) each independently ranges from 1 to 10, and the average of "j" in the siloxane-modified resin having the structural unit represented by the formula (C) ranges from 20 to 200.

(D)

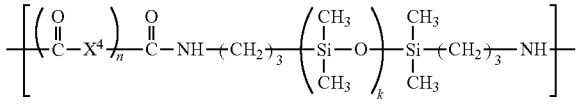

In the formula (D), $X^4$ represents a meta-phenylene group, a para-phenylene group, or a bivalent group having two para-phenylene groups bonded with an oxygen atom, n represents 0 or 1, and "k" represents the number of repetitions of a structure in parentheses, and the average of "k" in the siloxane-modified resin having a structural unit represented by the formula (D) ranges from 20 to 200.

The present invention also relates to a process cartridge that is detachably attachable to a main body of an electrophotographic apparatus. The process cartridge integrally supports the electrophotographic photosensitive member and at least one unit selected from the group consisting of a charging unit, a developing unit, a transferring unit, and a cleaning unit.

The present invention also relates to an electrophotographic apparatus that includes the electrophotographic photosensitive member, a charging unit, an exposure unit, a developing unit, and a transferring unit.

The present invention can provide an electrophotographic photosensitive member that can reduce the initial friction coefficient and occurrence of ghost images during repeated use of the electrophotographic photosensitive member, and a process cartridge and an electrophotographic apparatus each including the electrophotographic photosensitive member.

Further features of the present invention will become apparent from the following description of exemplary embodiments with reference to the attached drawings.

DESCRIPTION OF THE EMBODIMENTS

Figure 1:
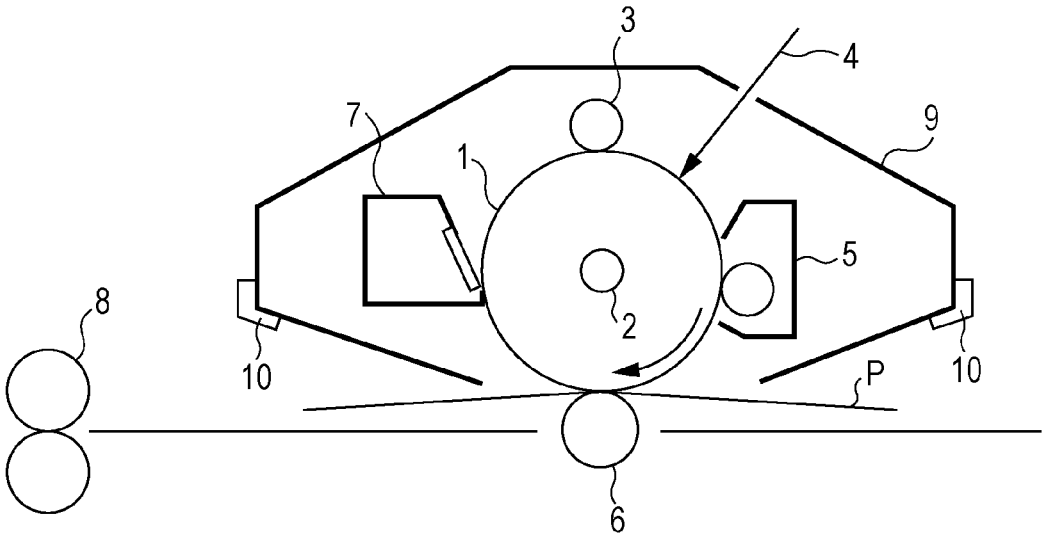
FIG. 1 is a schematic view of an electrophotographic apparatus that includes a process cartridge including an electrophotographic photosensitive member.

An electrophotographic photosensitive member according to an embodiment of the present invention includes a surface layer that contains the following (α) and (β) and a charge transporting substance.

(α) A siloxane-modified resin having a structural unit represented by any one of the following formulae (A), (B), (C), and (D).

(β) At least one compound selected from the group consisting of hexanol, heptanol, cyclohexanol, benzyl alcohol, ethylene glycol, 1,4-butanediol, 1,5-pentanediol, diethylene glycol, diethylene glycol ethyl methyl ether, ethylene carbonate, propylene carbonate, nitrobenzene, pyrrolidone, N-methylpyrrolidone, methyl benzoate, ethyl benzoate, benzyl acetate, ethyl 3-ethoxypropionate, acetophenone, methyl salicylate, dimethyl phthalate, and sulfolane.

(β) (hereinafter also referred to as a constituent β) in the surface layer of the electrophotographic photosensitive member can reduce the initial friction coefficient and occurrence of ghost images during repeated use of the electrophotographic photosensitive member. This is probably because of the following reason.

Ghosts can occur when a charge transporting substance in a surface layer aggregates and retards charge transfer. The aggregation of the charge transporting substance can result from low compatibility between the siloxane-modified resin and the charge transporting substance in the surface layer.

Compatibility between the constituent β and the charge transporting substance is generally higher than compatibility between the constituent β and the (α) (hereinafter also referred to as a constituent α).

Thus, the constituent β can suppress the decrease in compatibility between the constituent α and the charge transporting substance and thereby reduce the aggregation of the charge transporting substance. This can reduce occurrence of ghost images resulting from the aggregation of the charge transporting substance during repeated use of the electrophotographic photosensitive member.

<Constituent α>

The constituent (α) is a siloxane-modified resin having a structural unit represented by any one of the following formulae (A), (B), (C), and (D).

(A)

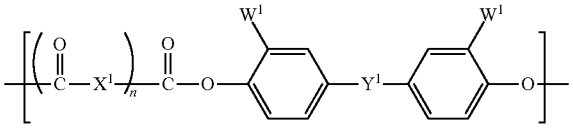

In the formula (A), $Y^1$ represents a single bond, a methylene group, an ethylidene group, a propylidene group, a phenylethylidene group, a cyclohexylidene group, or an oxygen atom, $X^1$ represents a meta-phenylene group, a para-phenylene group, or a bivalent group having two para-phenylene groups bonded with an oxygen atom, n represents 0 or 1, and $W^1$ represents a univalent group represented by the following formula (W1) or (W2).

(W1)

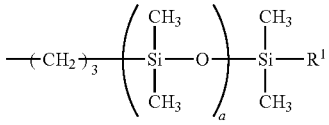

(W2)

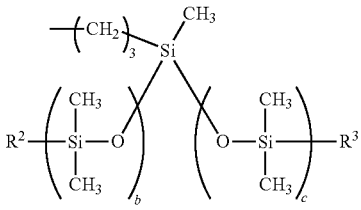

In the formulae (W1) and (W2), $R^1$ to $R^3$ each independently represents an alkyl group having 1 to 4 carbon atoms, "a" represents the number of repetitions of a structure in parentheses, and the average of "a" in the siloxane-modified resin having a structural unit represented by the formula (A) ranges from 10 to 150, and "b" and "c" each independently represents the number of repetitions of a structure in parentheses, and the average of b+c in the siloxane-modified resin having the structural unit represented by the formula (A) ranges from 10 to 150.

(B)

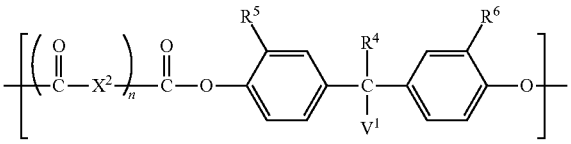

In the formulae (V1) and (V2), $R^7$ to $R^9$ each independently represents an alkyl group having 1 to 4 carbon atoms, "d" represents the number of repetitions of a structure in parentheses and ranges from 2 to 10, "e" represents the number of repetitions of a structure in parentheses, and the average of "e" in the siloxane-modified resin having a structural unit represented by the formula (B) ranges from 10 to 150, and "f" and "g" each independently represents the number of repetitions of a structure in parentheses, and the average of f+g in the siloxane-modified resin having the structural unit represented by the formula (B) ranges from 10 to 150.

(C)

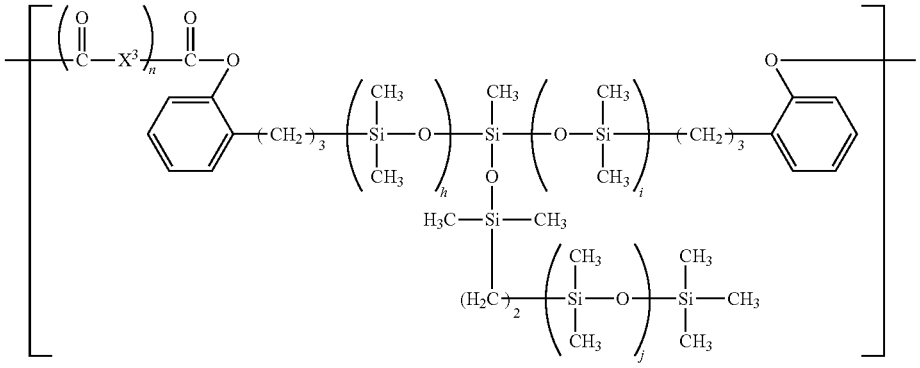

In the formula (B), $X^2$ represents a meta-phenylene group, a para-phenylene group, or a bivalent group having two para-phenylene groups bonded with an oxygen atom, n represents 0 or 1, $R^4$ to $R^6$ each independently represents a hydrogen atom, an alkyl group having 1 to 4 carbon atoms, or a phenyl group, and $V^1$ represents a univalent group represented by the following formula (V1) or (V2).

(V1)

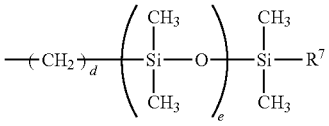

(V2)

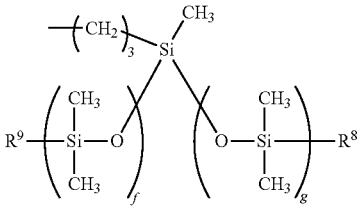

In the formula (C), $X^3$ represents a meta-phenylene group, a para-phenylene group, or a bivalent group having two para-phenylene groups bonded with an oxygen atom, n represents 0 or 1, "h", "I", and "j" each independently represents the number of repetitions of a structure in parentheses, and the average of "h" and the average of "I" in the siloxane-modified resin having a structural unit represented by the formula (C) each independently ranges from 1 to 10, and the average of "j" in the siloxane-modified resin having the structural unit represented by the formula (C) ranges from 20 to 200.

(D)

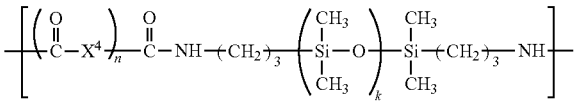

In the formula (D), $X^4$ represents a meta-phenylene group, a para-phenylene group, or a bivalent group having two para-phenylene groups bonded with an oxygen atom, n represents 0 or 1, and "k" represents the number of repetitions of a structure in parentheses, and the average of "k" in the siloxane-modified resin having a structural unit represented by the formula (D) ranges from 20 to 200.

When $X^1$ to $X^4$ in the formulae (A), (B), (C), and (D) are a meta-phenylene group or a para-phenylene group, the meta-phenylene group and the para-phenylene group may coexist. For example, the ratio of the meta-phenylene group to the para-phenylene group in $X^1$ to $X^4$ is preferably in the range of 3/7 to 7/3 (molar ratio), more preferably 1/1 (molar ratio).

Specific examples of the formula (A) will be described below.

TABLE 1

| Formula (A) | $Y^1$ | n | $X^1$ |
|---|---|---|---|
| (A-1) | methylene group | 0 | |
| (A-2) | ethylidene group | 0 | |
| (A-3) | propylidene group | 0 | |
| (A-4) | phenylethylidene group | 0 | |
| (A-5) | cyclohexylidene group | 0 | |
| (A-6) | oxygen atom | 0 | |
| (A-7) | single bond | 0 | |
| (A-8) | methylene group | 1 | m/p |
| (A-9) | ethylidene group | 1 | m/p |
| (A-10) | propylidene group | 1 | m/p |
| (A-11) | phenylethylidene group | 1 | m/p |
| (A-12) | cyclohexylidene group | 1 | m/p |
| (A-13) | oxygen atom | 1 | m/p |
| (A-14) | single bond | 1 | m/p |
| (A-15) | methylene group | 1 | p-O-p |
| (A-16) | ethylidene group | 1 | p-O-p |
| (A-17) | propylidene group | 1 | p-O-p |
| (A-18) | phenylethylidene group | 1 | p-O-p |
| (A-19) | cyclohexylidene group | 1 | p-O-p |
| (A-20) | oxygen atom | 1 | p-O-p |
| (A-21) | single bond | 1 | p-O-p |

In Table 1, "m/p" means that the meta-phenylene group/para-phenylene group ratio is 1/1 (molar ratio), and "p-O-p" refers to a bivalent group having two para-phenylene groups bonded with an oxygen atom.

Specific examples of the formula (B) will be described below.

TABLE 2

| Formula (B) | $R^3$ | $R^4$ | $R^5$ | n | $X^2$ |
|---|---|---|---|---|---|
| (B-1) | hydrogen atom | hydrogen atom | hydrogen atom | 0 | |
| (B-2) | methyl group | hydrogen atom | hydrogen atom | 0 | |
| (B-3) | hydrogen atom | methyl group | methyl group | 0 | |
| (B-4) | hydrogen atom | phenyl group | phenyl group | 0 | |
| (B-5) | hydrogen atom | tert-butyl group | tert-butyl group | 0 | |
| (B-6) | hydrogen atom | hydrogen atom | hydrogen atom | 1 | m/p |
| (B-7) | methyl group | hydrogen atom | hydrogen atom | 1 | m/p |
| (B-8) | hydrogen atom | methyl group | methyl group | 1 | m/p |
| (B-9) | hydrogen atom | phenyl group | phenyl group | 1 | m/p |
| (B-10) | hydrogen atom | tert-butyl group | tert-butyl group | 1 | m/p |
| (B-11) | hydrogen atom | hydrogen atom | hydrogen atom | 1 | p-O-p |
| (B-12) | methyl group | hydrogen atom | hydrogen atom | 1 | p-O-p |
| (B-13) | hydrogen atom | methyl group | methyl group | 1 | p-O-p |
| (B-14) | hydrogen atom | phenyl group | phenyl group | 1 | p-O-p |
| (B-15) | hydrogen atom | tert-butyl group | tert-butyl group | 1 | p-O-p |

In Table 2, "m/p" means that the meta-phenylene group/para-phenylene group ratio is 1/1 (molar ratio), and "p-O-p" refers to a bivalent group having two para-phenylene groups bonded with an oxygen atom.

Examples of the structural unit having the formula (C) will be described below.

TABLE 3

| Formula (C) | n | $X^3$ |
|---|---|---|
| (C-1) | 0 | |
| (C-2) | 1 | m/p |
| (C-3) | 1 | p-O-p |

In Table 3, "m/p" means that the meta-phenylene group/para-phenylene group ratio is 1/1 (molar ratio), and "p-O-p" refers to a bivalent group having two para-phenylene groups bonded with an oxygen atom.

Specific examples of the formula (D) will be described below.

TABLE 4

| Formula (D) | n | $X^4$ |
|---|---|---|
| (D-1) | 0 | |
| (D-2) | 1 | m/p |
| (D-3) | 1 | p-O-p |

In Table 4, "m/p" means that the meta-phenylene group/para-phenylene group ratio is 1/1 (molar ratio), and "p-O-p" refers to a bivalent group having two para-phenylene groups bonded with an oxygen atom.

The siloxane-modified resin having a structural unit represented by any one of the formulae (A), (B), (C), and (D) may further have a structural unit represented by the following formula (E).

(E)

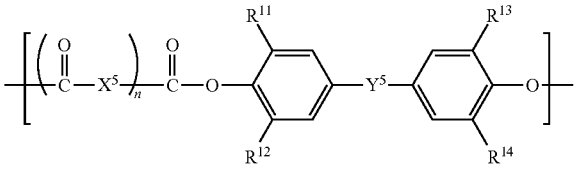

In the formula (E), $Y^5$ represents a single bond, a methylene group, an ethylidene group, a propylidene group, a phenylethylidene group, a cyclohexylidene group, or an oxygen atom, $X^5$ represents a meta-phenylene group, a para-phenylene group, or a bivalent group having two para-phenylene groups bonded with an oxygen atom, n represents 0 or 1, and $R^{11}$ to $R^{14}$ each independently represents a hydrogen atom, an alkyl group having 1 to 4 carbon atoms, or a phenyl group.

Examples of the structural unit having the formula (E) will be described below.

TABLE 5

| Structural unit having Formula (E) | $R^{11}$ | $R^{12}$ | $R^{13}$ | $R^{14}$ | $Y^5$ | n | $X^5$ |
|---|---|---|---|---|---|---|---|
| Structural unit example (E-1) | methyl group | methyl group | methyl group | methyl group | methylene group | 0 | |
| Structural unit example (E-2) | methyl group | hydrogen atom | methyl group | hydrogen atom | ethylidene group | 0 | |
| Structural unit example (E-3) | methyl group | hydrogen atom | methyl group | hydrogen atom | propylidene group | 0 | |
| Structural unit example (E-4) | hydrogen atom | hydrogen atom | hydrogen atom | hydrogen atom | phenylethylidene group | 0 | |
| Structural unit example (E-5) | hydrogen atom | hydrogen atom | hydrogen atom | hydrogen atom | cyclohexylidene group | 0 | |
| Structural unit example (E-6) | hydrogen atom | hydrogen atom | hydrogen atom | hydrogen atom | propylidene group | 0 | |
| Structural unit example (E-7) | hydrogen atom | hydrogen atom | hydrogen atom | hydrogen atom | single bond | 0 | |
| Structural unit example (E-8) | methyl group | hydrogen atom | methyl group | hydrogen atom | single bond | 0 | |
| Structural unit example (E-9) | methyl group | hydrogen atom | methyl group | hydrogen atom | methylene group | 1 | m/p |
| Structural unit example (E-10) | methyl group | hydrogen atom | methyl group | hydrogen atom | ethylidene group | 1 | m/p |
| Structural unit example (E-11) | methyl group | hydrogen atom | methyl group | hydrogen atom | propylidene group | 1 | m/p |

TABLE 5-continued

| Structural unit having Formula (E) | $R^{11}$ | $R^{12}$ | $R^{13}$ | $R^{14}$ | $Y^5$ | n | $X^5$ |
|---|---|---|---|---|---|---|---|
| Structural unit example (E-12) | methyl group | hydrogen atom | methyl group | hydrogen atom | phenylethylidene group | 1 | m/p |
| Structural unit example (E-13) | methyl group | hydrogen atom | methyl group | hydrogen atom | cyclohexylidene group | 1 | m/p |
| Structural unit example (E-14) | methyl group | methyl group | methyl group | methyl group | single bond | 1 | m/p |
| Structural unit example (E-15) | methyl group | methyl group | methyl group | methyl group | methylene group | 1 | m/p |
| Structural unit example (E-16) | methyl group | methyl group | methyl group | methyl group | methylene group | 1 | p-O-p |
| Structural unit example (E-17) | methyl group | hydrogen atom | methyl group | hydrogen atom | ethylidene group | 1 | p-O-p |
| Structural unit example (E-18) | methyl group | hydrogen atom | methyl group | hydrogen atom | propylidene group | 1 | p-O-p |
| Structural unit example (E-19) | methyl group | hydrogen atom | methyl group | hydrogen atom | cyclohexylidene group | 1 | p-O-p |

In Table 5, "m/p" means that the meta-phenylene group/para-phenylene group ratio is 1/1 (molar ratio), and "p-O-p" refers to a bivalent group having two para-phenylene groups bonded with an oxygen atom. The siloxane-modified resin may have one or two or more structural units represented by the formula (E).

In the present invention, terminal silicon atoms of siloxane, groups bonded to the terminal silicon atoms, oxygen atoms and silicon atoms between the terminal silicon atoms, and groups bonded to the silicon atoms constitute a siloxane moiety. For example, in the following structural units having the formulae ($W^1$-S) and (C-S), the siloxane moieties are surrounded by the broken lines.

The mass ratio of a siloxane moiety in the siloxane-modified resin can be determined in such a manner. The mass ratio of a siloxane moiety in the siloxane-modified resin depends on the amount of raw material of a monomer unit containing the siloxane moiety used in polymerization. Thus, the amount of raw material is controlled so as to achieve a target mass ratio of the siloxane moiety.

(W1-S)

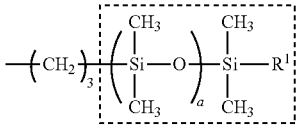

(C-S)

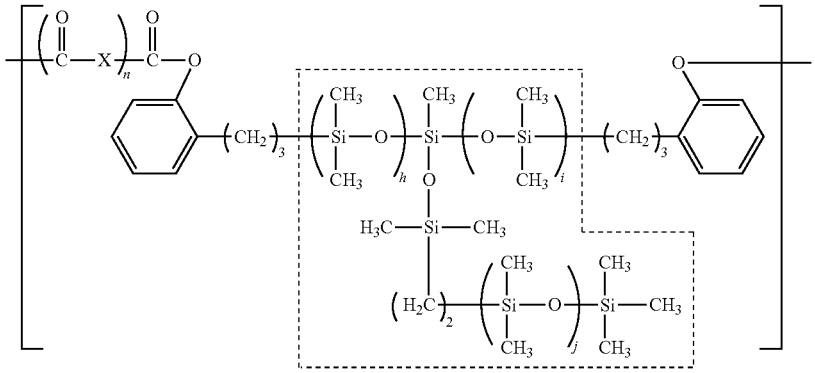

The siloxane moiety content of the siloxane-modified resin can be determined by a common analytical method. An example of the analytical method will be described below.

After a surface layer of an electrophotographic photosensitive member is dissolved in a solvent, the materials of the surface layer are fractionated with a fractionation apparatus, such as a size exclusion chromatograph or a high-performance liquid chromatograph, that can separate and collect the components of the surface layer. The fractionated materials of the siloxane-modified resin are subjected to $^1$H-NMR measurement. The constituent material structures and contents can be determined from the peak position and the peak area ratio of hydrogen atoms (the hydrogen atoms of the resin). On the basis of these results, the number of repetitions or the molar ratio of a siloxane unit are determined and converted into the content (mass ratio). Furthermore, the siloxane-modified resin is hydrolyzed into a carboxylic acid portion and a bisphenol portion, for example, in the presence of an alkali. The number of repetitions or the molar ratio of a siloxane unit in the resulting bisphenol portion are determined by nuclear magnetic resonance spectrometry or mass spectrometry and are converted into the content (mass ratio).

The siloxane moiety content of the siloxane-modified resin may range from 1% to 50% by mass of the total mass of the siloxane-modified resin.

The siloxane-modified resin may be a copolymer having a structural unit represented by any one of the formulae (A), (B), (C), and (D) and a structural unit represented by the formula (E). The copolymer may be a block copolymer, a random copolymer, or an alternating copolymer. A siloxane-modified resin may have no terminal siloxane structure.

The siloxane-modified resin preferably has a weight-average molecular weight in the range of 10,000 to 150,000, more preferably 20,000 to 100,000.

The term "weight-average molecular weight", as used herein, refers to a polystyrene equivalent weight-average molecular weight measured by a method described in Japanese Patent Laid-Open No. 2007-79555 by following routine procedures.

A synthesis example of a siloxane-modified polycarbonate resin will be described below.

The polycarbonate resin can be synthesized by a synthesis method described in Japanese Patent Laid-Open No. 5-158249, No. 10-182832, No. 2006-328416, or No. 2008-

195905. The constituents α (polycarbonate resins) described in the synthesis examples in Tables 6 to 9 are synthesized by the same synthesis method using the raw materials for the structural unit represented by any one of the formulae (A), (B), (C), and (D) and the structural unit represented by the formula (E). Tables 6 to 9 show the weight-average molecular weights and the siloxane moiety contents (% by mass) of the synthesized polycarbonate resins.

TABLE 6

| Synthesis example | Constituent α | Repeating unit having Formula (A) | n | W1 $R^1$ | a | W2 $R^2$ | b | c | Repeating unit having Formula (E) | Weight-average molecular weight (Mw) | Siloxane moiety content |
|---|---|---|---|---|---|---|---|---|---|---|---|
| 1 | Resin PC-A(1) | (A-1) | 0 | methyl group | 50 | | | | (E-3) | 40,000 | 3% |
| 2 | Resin PC-A(2) | (A-2) | 0 | methyl group | 50 | | | | (E-3) | 40,000 | 3% |
| 3 | Resin PC-A(3) | (A-3) | 0 | methyl group | 50 | | | | (E-3) | 40,000 | 3% |
| 4 | Resin PC-A(4) | (A-4) | 0 | methyl group | 50 | | | | (E-3) | 40,000 | 3% |
| 5 | Resin PC-A(5) | (A-5) | 0 | methyl group | 50 | | | | (E-3) | 40,000 | 3% |
| 6 | Resin PC-A(6) | (A-6) | 0 | methyl group | 50 | | | | (E-3) | 40,000 | 3% |
| 7 | Resin PC-A(7) | (A-7) | 0 | methyl group | 50 | | | | (E-3) | 40,000 | 3% |
| 8 | Resin PC-A(8) | (A-3) | 0 | methyl group | 20 | | | | (E-3) | 40,000 | 3% |
| 9 | Resin PC-A(9) | (A-3) | 0 | methyl group | 200 | | | | (E-3) | 40,000 | 3% |
| 10 | Resin PC-A(10) | (A-3) | 0 | an ethyl group | 50 | | | | (E-3) | 40,000 | 3% |
| 11 | Resin PC-A(11) | (A-3) | 0 | | | methyl group | 50 | 50 | (E-3) | 40,000 | 3% |
| 12 | Resin PC-A(12) | (A-3) | 0 | | | methyl group | 30 | 100 | (E-3) | 40,000 | 3% |
| 13 | Resin PC-A(13) | (A-3) | 0 | methyl group | 50 | | | | (E-3) | 20,000 | 3% |
| 14 | Resin PC-A(14) | (A-3) | 0 | methyl group | 50 | | | | (E-3) | 60,000 | 3% |
| 15 | Resin PC-A(15) | (A-3) | 0 | methyl group | 50 | | | | (E-3) | 40,000 | 1% |
| 16 | Resin PC-A(16) | (A-3) | 0 | methyl group | 50 | | | | (E-3) | 40,000 | 50% |

"a", "b", and "c" in Table 6 refer to the averages of a, b, and c of a siloxane-modified resin having a structural unit represented by the formula (A).

TABLE 7

| Synthesis example | Constituent α | Repeating unit having Formula (B) | n | V1 $R^6$ | d | e | V2 $R^7$ | f | g | Repeating unit having Formula (E) | Weight-average molecular weight (Mw) | Siloxane moiety content |
|---|---|---|---|---|---|---|---|---|---|---|---|---|
| 17 | Resin PC-B(1) | (B-1) | 0 | tert-butyl group | 10 | 40 | | | | (E-5) | 40,000 | 3% |
| 18 | Resin PC-B(2) | (B-2) | 0 | tert-butyl group | 10 | 40 | | | | (E-5) | 40,000 | 3% |
| 19 | Resin PC-B(3) | (B-3) | 0 | tert-butyl group | 10 | 40 | | | | (E-5) | 40,000 | 3% |
| 20 | Resin PC-B(4) | (B-4) | 0 | tert-butyl group | 10 | 40 | | | | (E-5) | 40,000 | 3% |
| 21 | Resin PC-B(5) | (B-5) | 0 | tert-butyl group | 10 | 40 | | | | (E-5) | 40,000 | 3% |
| 22 | Resin PC-B(6) | (B-3) | 0 | tert-butyl group | 2 | 40 | | | | (E-5) | 40,000 | 3% |
| 23 | Resin PC-B(7) | (B-3) | 0 | methyl group | 10 | 20 | | | | (E-5) | 40,000 | 3% |
| 24 | Resin PC-B(8) | (B-3) | 0 | methyl group | 10 | 150 | | | | (E-5) | 40,000 | 3% |
| 25 | Resin PC-B(9) | (B-3) | 0 | | | | methyl group | 30 | 30 | (E-5) | 40,000 | 3% |
| 26 | Resin PC-B(10) | (B-3) | 0 | | | | methyl group | 20 | 50 | (E-5) | 40,000 | 3% |
| 27 | Resin PC-B(11) | (B-3) | 0 | tert-butyl group | 10 | 40 | | | | (E-5) | 20,000 | 3% |
| 28 | Resin PC-B(12) | (B-3) | 0 | tert-butyl group | 10 | 40 | | | | (E-5) | 60,000 | 3% |
| 29 | Resin PC-B(13) | (B-3) | 0 | tert-butyl group | 10 | 40 | | | | (E-5) | 40,000 | 1% |
| 30 | Resin PC-B(14) | (B-3) | 0 | tert-butyl group | 10 | 40 | | | | (E-5) | 40,000 | 50% |

"e", "f", and "g" in Table 7 refer to the averages of e, f, and g of a siloxane-modified resin having a structural unit represented by the formula (B).

TABLE 8

| Synthesis example | Constituent α | Repeating unit having Formula (C) | n | h | i | j | Repeating unit having Formula (E) | Weight-average molecular weight (Mw) | Siloxane moiety content |
|---|---|---|---|---|---|---|---|---|---|
| 31 | Resin PC-C(1) | (C-1) | 0 | 1 | 1 | 50 | (E-5) | 40,000 | 3% |
| 32 | Resin PC-C(2) | (C-1) | 0 | 1 | 1 | 20 | (E-5) | 40,000 | 3% |
| 33 | Resin PC-C(3) | (C-1) | 0 | 1 | 1 | 150 | (E-5) | 40,000 | 3% |
| 34 | Resin PC-C(4) | (C-1) | 0 | 1 | 1 | 50 | (E-5) | 20,000 | 3% |
| 35 | Resin PC-C(5) | (C-1) | 0 | 1 | 1 | 50 | (E-5) | 60,000 | 3% |
| 36 | Resin PC-C(6) | (C-1) | 0 | 1 | 1 | 50 | (E-5) | 100,000 | 3% |
| 37 | Resin PC-C(7) | (C-1) | 0 | 1 | 1 | 50 | (E-3) | 40,000 | 3% |
| 38 | Resin PC-C(8) | (C-1) | 0 | 1 | 1 | 50 | (E-5) | 40,000 | 1% |
| 39 | Resin PC-C(9) | (C-1) | 0 | 1 | 1 | 50 | (E-5) | 40,000 | 50% |

"h", "i", and "j" in Table 8 refer to the averages of h, i, and j of a siloxane-modified resin having a structural unit represented by the formula (C).

TABLE 9

| Synthesis example | Constituent α | Repeating unit having Formula (D) | n | k | Repeating unit having Formula (E) | Weight-average molecular weight (Mw) | Siloxane moiety content |
|---|---|---|---|---|---|---|---|
| 40 | Resin PC-D(1) | (D-1) | 0 | 50 | (E-5) | 40,000 | 3% |
| 41 | Resin PC-D(2) | (D-1) | 0 | 20 | (E-5) | 40,000 | 3% |
| 42 | Resin PC-D(3) | (D-1) | 0 | 150 | (E-5) | 40,000 | 3% |
| 43 | Resin PC-D(4) | (D-1) | 0 | 50 | (E-5) | 20,000 | 3% |
| 44 | Resin PC-D(5) | (D-1) | 0 | 50 | (E-5) | 60,000 | 3% |
| 45 | Resin PC-D(7) | (D-1) | 0 | 50 | (E-3) | 40,000 | 3% |
| 46 | Resin PC-D(8) | (D-1) | 0 | 50 | (E-5)/(E-6)/(E-7) = 4/5/1 | 40,000 | 3% |
| 47 | Resin PC-D(9) | (D-1) | 0 | 50 | (E-3) | 40,000 | 3% |
| 48 | Resin PC-D(10) | (D-1) | 0 | 50 | (E-5) | 40,000 | 1% |
| 49 | Resin PC-D(11) | (D-1) | 0 | 50 | (E-5) | 40,000 | 50% |

"k" in Table 9 refers to the average of k in a siloxane-modified resin having a structural unit represented by the formula (D).

A synthesis example of a siloxane-modified polyester resin will be described below.

The polyester resin can be synthesized by a synthesis method described in Japanese Patent Laid-Open No. 05-043670, No. 08-234468, or No. 2009-084556. The constituents α (polyester resins) described in the synthesis examples in Tables 10 to 13 are synthesized by the same synthesis method using the raw materials for the structural unit represented by any one of the formulae (A), (B), (C), and (D) and the structural unit represented by the formula (E). Tables 10 to 13 show the weight-average molecular weights and the siloxane moiety contents (% by mass) of the synthesized polyester resins.

TABLE 10

| Synthesis example | Constituent α | Repeating unit having Formula (A) | n | W1 $R^1$ | a | W2 $R^2$ | b | c | Repeating unit having Formula (E) | Weight-average molecular weight (Mw) | Siloxane moiety content |
|---|---|---|---|---|---|---|---|---|---|---|---|
| 50 | Resin PE-A(1) | (A-14) | 1 | methyl group | 50 | | | | (E-18) | 40,000 | 3% |
| 51 | Resin PE-A(2) | (A-17) | 1 | | | methyl group | 50 | 50 | (E-18) | 40,000 | 3% |

"a", "b", and "c" in Table 10 refer to the averages of a, b, and c of a siloxane-modified resin having a structural unit represented by the formula (A).

TABLE 11

| Synthesis example | Constituent α | Repeating unit having Formula (B) | n | V1 $R^6$ | d | e | V2 $R^7$ | f | g | Repeating unit having Formula (E) | Weight-average molecular weight (Mw) | Siloxane moiety content |
|---|---|---|---|---|---|---|---|---|---|---|---|---|
| 52 | Resin PE-B(1) | (B-8) | 1 | | | | methyl group | 50 | 50 | (E-18) | 40,000 | 3% |
| 53 | Resin PE-B(2) | (B-12) | 1 | methyl group | 50 | 50 | | | | (E-18) | 40,000 | 3% |

"e", "f", and "g" in Table 11 refer to the averages of e, f, and g of a siloxane-modified resin having a structural unit represented by the formula (B).

TABLE 12

| Synthesis example | Constituent α | Repeating unit having Formula (C) | n | h | i | j | Repeating unit having Formula (E) | Weight-average molecular weight (Mw) | Siloxane moiety content |
|---|---|---|---|---|---|---|---|---|---|
| 54 | Resin PE-C(1) | (C-2) | 1 | 1 | 1 | 50 | (E-18) | 40,000 | 3% |
| 55 | Resin PE-C(2) | (C-3) | 1 | 1 | 1 | 50 | (E-18) | 40,000 | 3% |

"h", "i", and "j" in Table 12 refer to the averages of h, i, and j of a siloxane-modified resin having a structural unit represented by the formula (C).

TABLE 13

| Synthesis example | Constituent α | Repeating unit having Formula (D) | n | k | Repeating unit having Formula (E) | Weight-average molecular weight (Mw) | Siloxane moiety content |
|---|---|---|---|---|---|---|---|
| 56 | Resin PE-D(1) | (D-2) | 1 | 50 | (E-18) | 40,000 | 3% |
| 57 | Resin PE-D(2) | (D-2) | 1 | 50 | (E-11) | 40,000 | 3% |
| 58 | Resin PE-D(3) | (D-3) | 1 | 50 | (E-18) | 40,000 | 3% |

"k" in Table 13 refers to the average of k in a siloxane-modified resin having a structural unit represented by the formula (D).

In order to reduce the initial friction coefficient and occurrence of ghost images during repeated use of an electrophotographic photosensitive member according to an embodiment of the present invention, the constituent α content of a surface layer (a charge transporting layer or a protective layer) of the electrophotographic photosensitive member preferably ranges from 0.1% to 60% by mass, more preferably 1% to 45% by mass, of the total mass of the surface layer.

<Constituent β>

The surface layer contains, as the constituent β, at least one compound selected from the group consisting of hexanol, heptanol, cyclohexanol, benzyl alcohol, ethylene glycol, 1,4-butanediol, 1,5-pentanediol, diethylene glycol, diethylene glycol ethyl methyl ether, ethylene carbonate, propylene carbonate, nitrobenzene, pyrrolidone, N-methylpyrrolidone, methyl benzoate, ethyl benzoate, benzyl acetate, ethyl 3-ethoxypropionate, acetophenone, methyl salicylate, dimethyl phthalate, and sulfolane.

These compounds can reduce occurrence of ghost images during repeated use of the electrophotographic photosensitive member. The constituent β content preferably ranges from 0.001% to 3.0% by mass, more preferably 0.001% to 2.0% by mass, of the total mass of the surface layer. This results in a particular decrease in initial friction coefficient and occurrence of ghost images during repeated use of the electrophotographic photosensitive member.

The surface layer is formed by forming a film of a surface layer coating solution containing the constituent β on a support and heating and drying the film.

Since the constituent β easily volatiles during heat-drying in the formation of the surface layer, the constituent β content of the surface layer coating solution can be higher than the constituent β content of the surface layer. The constituent β content of the surface layer coating solution may range from 5% to 80% by mass of the total mass of the surface layer coating solution.

The constituent β content of the surface layer can be measured by the following method. The constituent β content of the surface layer can be measured with an HP7694 Headspace sampler (manufactured by Agilent Technologies) and HP6890 series GS System (manufactured by Agilent Technologies). The settings of the Headspace sampler include Oven 150° C., Loop 170° C., and Transfer Line 190° C. A 5 mm×40 mm piece (test piece) cut from an electrophotographic photosensitive member having a surface layer is placed in a vial in the Headspace sampler. Generated gases are analyzed with a gas chromatograph (HP6890 series GS System). After the analysis, the mass of the surface layer is calculated as a difference between the mass of the test piece taken from the vial and the mass of the test piece from which the surface layer has been removed. The test piece from which the surface layer has been removed is prepared by immersing the test piece taken from the vial in methyl ethyl ketone for 5 minutes to remove the surface layer and then drying the test piece at 100° C. for 5 minutes. The constituent β content of the surface layer is measurement by this method.

The structure of an electrophotographic photosensitive member according to an embodiment of the present invention will be described below.

Figure 4A:
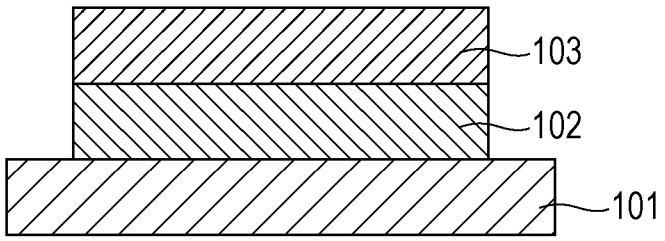
FIGS. 4A and 4B are schematic views of an example of a layered structure of an electrophotographic photosensitive member.
Figure 4B:
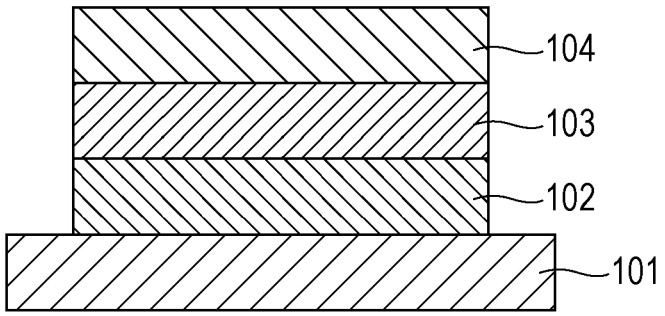

An electrophotographic photosensitive member according to an embodiment of the present invention includes a support, a charge generating layer formed on the support, and a charge transporting layer formed on the charge generating layer. FIGS. 4A and 4B are schematic views of the layered structure of an electrophotographic photosensitive member according to an embodiment of the present invention. In FIGS. 4A and 4B, 101 denotes a support, 102 denotes a charge generating layer, 103 denotes a charge transporting layer, and 104 denotes a protective layer (a second charge transporting layer).

The charge generating layer may have a multilayer structure, and the charge transporting layer may have a multilayer structure. In the case that the charge transporting layer is the surface layer, the charge transporting layer contains the constituent α, the constituent β, and a charge transporting substance. The charge transporting layer may be covered with a protective layer (a surface layer). In this case, the protective layer contains the constituent α, the constituent β, and a charge transporting substance.

[Support]

The support may be an electrically conductive support. For example, the support is made of a metal, such as aluminum, stainless steel, copper, nickel, or zinc, or an alloy thereof. An aluminum or aluminum alloy support may be an ED tube, an EI tube, or a support manufactured by cutting, electrochemical mechanical polishing, or wet or dry honing of these tubes. The support may be a metal or resin support covered with a thin film made of aluminum, an aluminum alloy, or an electrically conductive material, such as an indium oxide-tin oxide alloy.

The support may contain electrically conductive particles, such as carbon black, tin oxide particles, titanium oxide particles, or silver particles, dispersed in a resin. The support may also be a plastic containing an electrically conductive binder resin.

In order to prevent interference fringes due to the scattering of a laser beam, the surface of the electrically conductive support may be subjected to cutting, surface roughening, or alumite treatment.

In an electrophotographic photosensitive member according to an embodiment of the present invention, an electrically conductive layer containing electrically conductive particles and a resin may be formed on the support. The electrically conductive layer is formed of a film of an electrically conductive layer coating solution containing electrically conductive particles dispersed in a binder resin.

Examples of the electrically conductive particles include, but are not limited to, carbon black, acetylene black, powders of aluminum, nickel, iron, nichrome, copper, zinc, silver, and other metals, and powders of metal oxides, such as electrically conductive tin oxide and indium-tin oxide (ITO).

Examples of the binder resin for use in the electrically conductive layer include, but are not limited to, polyester resins, polycarbonate resins, poly(vinyl butyral), acrylic resins, silicone resins, epoxy resins, melamine resins, urethane resins, phenolic resins, and alkyd resins.

Examples of solvents for use in the electrically conductive layer coating solution include, but are not limited to, ether solvents, alcohol solvents, ketone solvents, and aromatic hydrocarbon solvents. The electrically conductive layer preferably has a thickness in the range of 0.2 to 40 μm, more preferably 1 to 35 μm, still more preferably 5 to 30 μm.

An undercoat layer may be disposed between the support or the electrically conductive layer and the charge generating layer.

The undercoat layer may be formed by forming a film of an undercoat layer coating solution containing a binder resin on the support or the electrically conductive layer and drying or hardening the film.

Examples of the binder resin for use in the undercoat layer include, but are not limited to, poly(acrylic acid), methylcellulose, ethylcellulose, polyamide resins, polyimide resins, polyamideimide resins, poly(amic acid) resins, melamine resins, epoxy resins, and polyurethane resins. The binder resin for use in the undercoat layer may be a thermoplastic resin, more specifically, a thermoplastic polyamide resin. The polyamide resin may be a low-crystallinity or amorphous nylon copolymer that can be applied in a solution form.

Examples of solvents for use in the undercoat layer coating solution include, but are not limited to, ether solvents, alcohol solvents, ketone solvents, and aromatic hydrocarbon solvents. The undercoat layer preferably has a thickness in the range of 0.05 to 40 μm, more preferably 0.1 to 30 μm. The undercoat layer may contain semiconductive particles, an electron transporting substance, or an electron accepting substance.

[Charge Generating Layer]

A charge generating layer is formed on the support, the electrically conductive layer, or the undercoat layer.

Specific examples of charge generating substances for use in an electrophotographic photosensitive member according to an embodiment of the present invention include, but are not limited to, azo pigments, phthalocyanine pigments, indigo pigments, and perylene pigments. These charge generating substances may be used alone or in combination. In particular, oxytitanium phthalocyanine, hydroxygallium phthalocyanine, and chlorogallium phthalocyanine have high sensitivity.

The charge generating layer may contain a binder resin, such as a polycarbonate resin, a polyester resin, a butyral resin, a poly(vinyl acetal) resin, an acrylic resin, a vinyl acetate resin, or a urea resin. The binder resin may be a butyral resin. These resins may be used alone or in combination as a mixture or a copolymer.

The charge generating layer may be formed by forming a film of a charge generating layer coating solution and drying the film. The charge generating layer coating solution is prepared by dispersing a charge generating substance in a solvent together with a binder resin. The charge generating layer may also be an evaporated film of a charge generating substance.

The dispersion may be performed with a homogenizer, ultrasonic waves, a ball mill, a sand mill, an attritor, or a rolling mill.

The mass ratio of the charge generating substance to the binder resin preferably ranges from 0.1 to 10, more preferably 1 to 3.

Examples of the solvent for use in the charge generating layer coating solution include, but are not limited to, alcohol solvents, sulfoxide solvents, ketone solvents, ether solvents, ester solvents, and aromatic hydrocarbon solvents.

The charge generating layer preferably has a thickness in the range of 0.01 to 5 μm, more preferably 0.1 to 2 μm.

The charge generating layer may contain an intensifier, an antioxidant, an ultraviolet absorber, and/or a plasticizer, if necessary. In order to facilitate the flow of electric charges (carriers) in the charge generating layer, the charge generating layer may contain an electron transporting substance and/or an electron accepting substance.

[Charge Transporting Layer]

An electrophotographic photosensitive member according to an embodiment of the present invention includes a charge transporting layer on a charge generating layer.

The charge transporting layer and a surface layer contain a charge transporting substance, such as a triarylamine compound, a hydrazone compound, a styryl compound, a stilbene compound, or an enamine compound. These charge transporting substances may be used alone or in combination. The following are exemplary charge transporting substances.

(CTM-1)

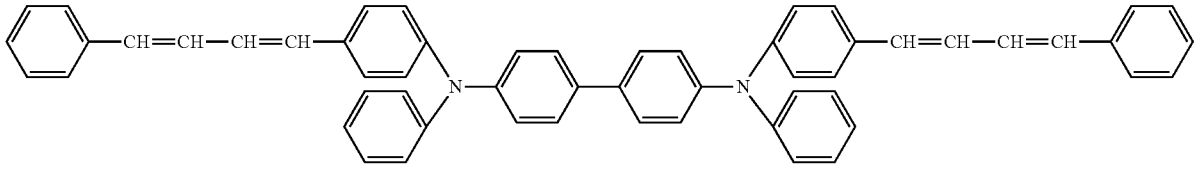

(CTM-2)

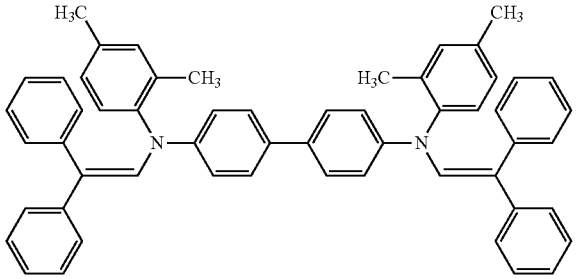

(CTM-3)

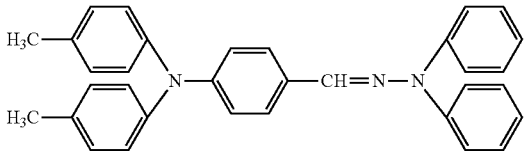

-continued (CTM-4)

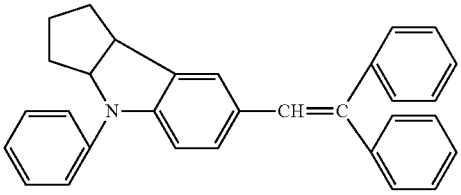

(CTM-5)

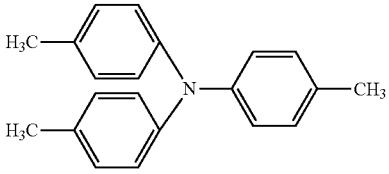

(CTM-6)

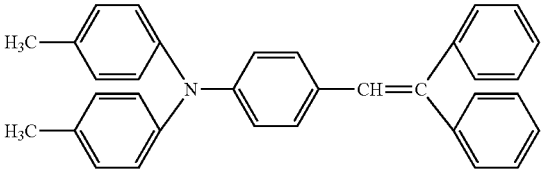

(CTM-7)

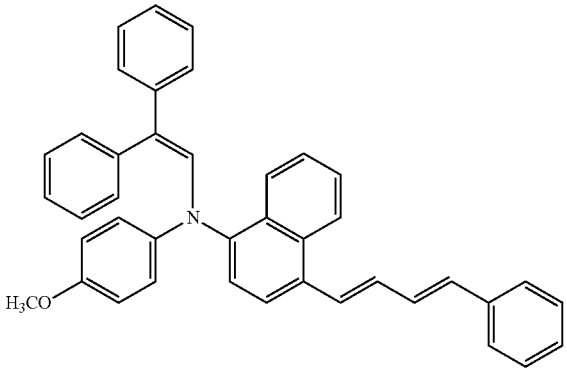

(CTM-8)

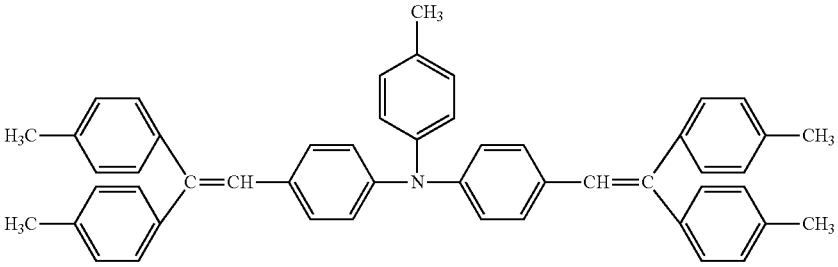

(CTM-9)

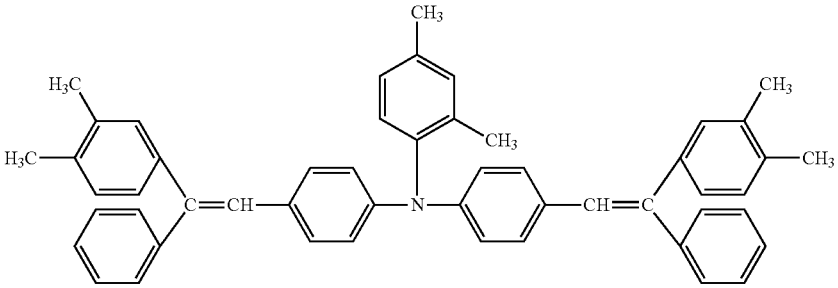

The charge transporting layer may be formed by forming a film of a charge transporting layer coating solution and drying the film. The charge transporting layer coating solution is prepared by dissolving a charge transporting substance in a solvent together with a binder resin.

The surface layer (the charge transporting layer or a protective layer) contains the constituent α as a resin and may contain an additional resin. The additional resin may be a polycarbonate resin or a polyester resin. The polycarbonate resin or the polyester resin may be a resin E having a structural unit represented by the formula (E). Examples of the structural unit represented by the formula (E) include, but are not limited to, the structural units represented by the formulae (E-1) to (E-19) described above. The resin E having a structural unit represented by the formula (E) may be a polymer having one structural unit represented by the formula (E) or a copolymer having two or more structural units represented by the formula (E). Among these, the structural unit represented by the formula (E) may be the structural unit represented by the formula (E-3), (E-4), (E-5), (E-15), (E-17), or (E-18). The additional resin may have no siloxane moiety. When the surface layer contains the resin E, the mass ratio of the resin E to the siloxane-modified resin may range from 1/9 to 50/1.

The resin E can be synthesized by a method described in Japanese Patent Laid-Open No. 2006-328416, No. 05-043670, or No. 08-234468. Tables 14 and 15 show synthesis examples of the resin E (polycarbonate resins and polyester resins).

TABLE 14

| Synthesis example | Polycarbonate resin | Repeating unit having Formula (E) | n | Weight-average molecular weight (Mw) |
|---|---|---|---|---|
| 59 | Resin PC-E(1) | (E-3) | 0 | 30,000 |
| 60 | Resin PC-E(2) | (E-3) | 0 | 50,000 |
| 61 | Resin PC-E(3) | (E-4) | 0 | 40,000 |
| 62 | Resin PC-E(4) | (E-5) | 0 | 30,000 |
| 63 | Resin PC-E(5) | (E-5) | 0 | 60,000 |
| 64 | Resin PC-E(6) | (E-5)/(E-6)/(E-7) = 4/5/1 | 0 | 40,000 |

"(E-5)/(E-6)/(E-7) = 4/5/1" in the synthesis example 64 refers to a copolymerization ratio (molar ratio).

TABLE 15

| Synthesis example | Polyester resin | Repeating unit having Formula (E) | n | Weight-average molecular weight (Mw) |
|---|---|---|---|---|
| 65 | Resin PE-E(1) | (E-15) | 1 | 20,000 |
| 66 | Resin PE-E(2) | (E-15) | 1 | 50,000 |
| 67 | Resin PE-E(3) | (E-17) | 1 | 20,000 |
| 68 | Resin PE-E(4) | (E-17) | 1 | 40,000 |
| 69 | Resin PE-E(5) | (E-18) | 1 | 30,000 |

The charge transporting layer preferably has a thickness in the range of 5 to 50 μm, more preferably 10 to 30 μm.

The mass ratio of the charge transporting substance to the binder resin ranges from 5:1 to 1:5, preferably 3:1 to 1:3. In order to reduce occurrence of ghost images during repeated use of an electrophotographic photosensitive member, the charge transporting substance content of the surface layer ranges from 20% to 50% by mass of the total mass of the surface layer.

Examples of the solvent for use in the charge transporting layer coating solution include, but are not limited to, alcohol solvents, sulfoxide solvents, ketone solvents, ether solvents, ester solvents, and aromatic hydrocarbon solvents. The solvent for use in the charge transporting layer coating solution may be xylene, toluene, or tetrahydrofuran.

Each layer of an electrophotographic photosensitive member according to an embodiment of the present invention may contain various additive agents. Examples of the additive agents include, but are not limited to, antidegradants, such as antioxidants, ultraviolet absorbers, and light stabilizers, and fine particles, such as organic fine particles and inorganic fine particles.

Examples of the antidegradants include, but are not limited to, hindered phenol antioxidants, hindered amine light stabilizers, antioxidants containing a sulfur atom, and antioxidants containing a phosphorus atom.

Examples of the organic fine particles include, but are not limited to, polymer resin particles, such as resin particles containing a fluorine atom, polystyrene fine particles, and polyethylene resin particles. Examples of the inorganic fine particles include, but are not limited to, metal oxides, such as silica and alumina.

These coating solutions may be applied by dip coating, spray coating, spinner coating, roller coating, Mayer bar coating, or blade coating. These coating solutions may be applied by dip coating.

The drying temperature of the coating solution to form each layer may range from 60° C. to 150° C. The drying temperature for the charge transporting layer coating solution (surface layer coating solution) may range from 110° C. to 140° C. The drying time preferably ranges from 10 to 60 minutes, more preferably 20 to 60 minutes.

[Electrophotographic Apparatus]

FIG. 1 is a schematic view of an electrophotographic apparatus that includes a process cartridge including an electrophotographic photosensitive member according to an embodiment of the present invention.

In FIG. 1, a cylindrical electrophotographic photosensitive member 1 rotates around a shaft 2 in the direction of the arrow at a predetermined peripheral speed. The surface of the rotating electrophotographic photosensitive member 1 is charged to a predetermined negative potential with a charging unit (a primary charging unit, such as a charging roller) 3. The electrophotographic photosensitive member 1 is then irradiated with intensity-modulated exposure light (image exposure light) 4 emitted from an exposure unit (not shown), such as a slit exposure unit or a laser beam scanning exposure unit, in response to the time-series electric digital image signals of intended image information. In this way, an electrostatic latent image corresponding to the intended image is formed on the surface of the electrophotographic photosensitive member 1.

The electrostatic latent image formed on the surface of the electrophotographic photosensitive member 1 is developed by reversal development with toner contained in a developer of a developing unit 5 to form a toner image. The toner image on the surface of the electrophotographic photosensitive member 1 is then transferred to a transfer material (such as a paper sheet) P while receiving a transfer bias from a transferring unit (such as a transfer roller) 6. The transfer material P is fed from a transfer material supply unit (not shown) to a contact portion between the electrophotographic photosensitive member 1 and the transferring unit 6 in synchronism with the rotation of the electrophotographic photosensitive member 1. A bias voltage having polarity opposite to the polarity of the electric charges of the toner is applied to the transferring device 6 with a bias power supply (not shown).

The transfer material P to which the toner image has been transferred is separated from the electrophotographic photosensitive member 1 and is sent to a fixing unit 8, in which the toner image is fixed. The resulting image-formed article (a print or copy) is then transported to the outside of the apparatus.

After toner image transfer, the surface of the electrophotographic photosensitive member 1 is cleared of residual developer (residual toner) with a cleaning unit (such as a cleaning blade) 7. After removal of electricity using pre-exposure light (not shown) emitted from a pre-exposure unit (not shown), the electrophotographic photosensitive member 1 is again used for image forming. In the case that the charging unit 3 is a contact charging unit, such as a charging roller, as illustrated in FIG. 1, pre-exposure is not necessarily required.

A plurality of components selected from the electrophotographic photosensitive member 1, the charging unit 3, the developing unit 5, the transferring unit 6, and the cleaning unit 7 may be placed in a container to constitute a process cartridge. The process cartridge may be detachably attached to an electrophotographic apparatus main body, such as a copying machine or a laser-beam printer. In FIG. 1, the electrophotographic photosensitive member 1, the charging unit 3, the developing unit 5, and the cleaning unit 7 are integrally supported in a cartridge 9. The process cartridge 9 can be attached to and detached from the electrophotographic apparatus main body through a guide 10, such as rails.

EXAMPLES

The present invention will be further described in the following examples and comparative examples. The present invention is not limited to these examples. The term "part" in the examples refers to "part by mass". Tables 16 to 33 show the results for Examples 1 to 154 and Comparative Examples 1 to 112.

Example 1

An aluminum cylinder having a diameter of 24 mm and a length of 257 mm was used as a support (electrically conductive support).

An electrically conductive layer coating solution was prepared from 10 parts of $SnO_2$-coated barium sulfate (electrically conductive particles), 2 parts of titanium oxide (an electrical resistance control pigment), 6 parts of a phenolic resin (a binder resin), 0.001 parts of a silicone oil (a leveling agent), and a mixed solvent of 4 parts of methanol and 16 parts of methoxypropanol.

The electrically conductive layer coating solution was applied to the support by dip coating and was hardened (heat cured) at 140° C. for 30 minutes to form an electrically conductive layer having a thickness of 15 μm.

3 parts of N-methoxymethylated nylon and 3 parts of a nylon copolymer were dissolved in a mixed solvent of 65 parts of methanol and 30 parts of n-butanol to prepare an undercoat layer coating solution.

The undercoat layer coating solution was applied to the electrically conductive layer by dip coating and was dried at 80° C. for 10 minutes to form an undercoat layer having a thickness of 0.7 μm.

10 parts of hydroxy gallium phthalocyanine crystals (a charge generating substance) in a crystal form having strong peaks at Bragg angle 2θ±0.2 degrees of 7.5, 9.9, 16.3, 18.6, 25.1, and 28.3 degrees in CuKα characteristic X-ray diffraction were used. The hydroxy gallium phthalocyanine crystals were added to 5 parts of poly(vinyl butyral) resin (trade name: S-Lec BX-1 manufactured by Sekisui Chemical Co., Ltd.) dissolved in 250 parts of cyclohexanone. The mixture was dispersed in a sand mill including glass beads having a diameter of 1 mm at 23±3° C. for one hour. 250 parts of ethyl acetate was added to the mixture to prepare a charge generating layer coating solution.

The charge generating layer coating solution was applied to the undercoat layer by dip coating and was dried at 100° C. for 10 minutes to form a charge generating layer having a thickness of 0.3 μm.

A charge transporting layer coating solution was prepared by dissolving 9 parts of a compound having the formula (CTM-1), 1 part of resin PC-A(1), 9 parts of resin PC-E(2), and 10 parts of methyl benzoate in 65 parts of tetrahydrofuran (THF).

The charge transporting layer coating solution was applied to the charge generating layer by dip coating and was dried at 125° C. for 40 minutes to form a charge transporting layer having a thickness of 16 μm. Thus, an electrophotographic photosensitive member that included the electrically conductive layer, the undercoat layer, the charge generating layer, and the charge transporting layer (surface layer) was manufactured.

The charge transporting layer contained 0.12% by mass methyl benzoate as measured by the gas chromatography method described above.

Evaluation will now be described below. Ghost images during repeated use of the electrophotographic photosensitive member and the initial friction coefficient were measured.

<Observation of Ghost Images>

Figure 2:
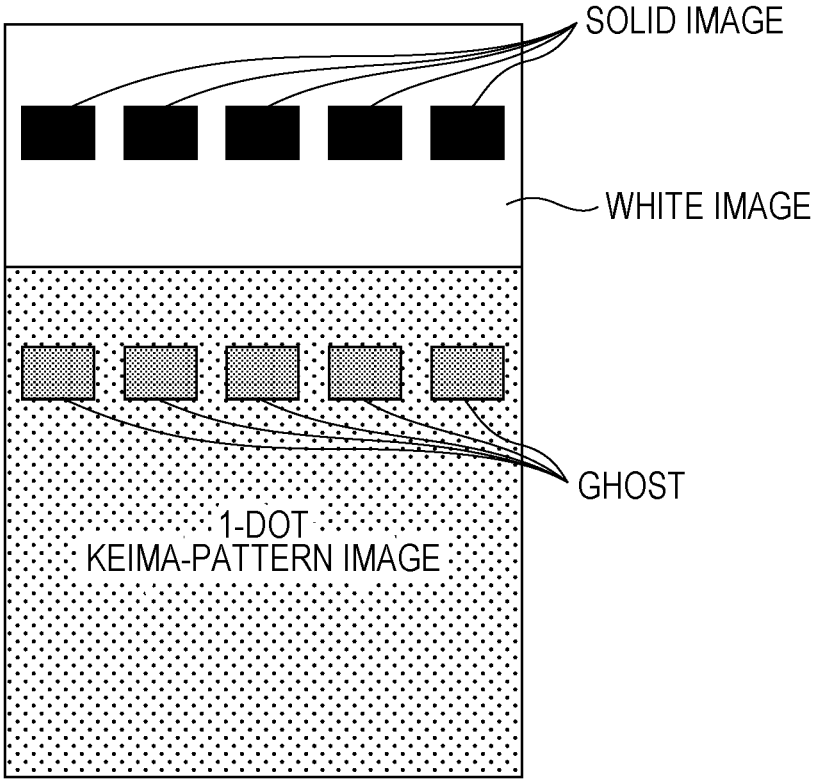
FIG. 2 is an explanatory view of a printed image used in the measurement of ghost potential and ghost images.
Figure 3:
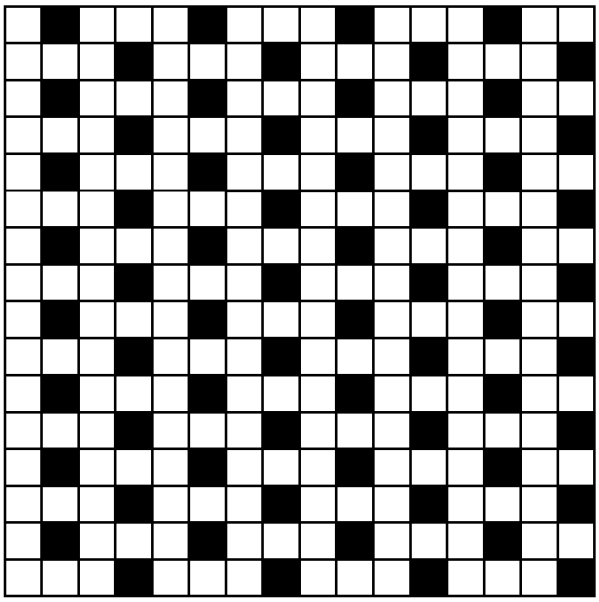
FIG. 3 is an explanatory view of a 1-dot Keima-pattern (similar to knight-jump pattern) image.

Ghost images were observed with HP Color LaserJet 3700 manufactured by Hewlett-Packard Co. (to which a cylindrical electrophotographic photosensitive member having a diameter of 24 mm could be attached). A process cartridge that included the electrophotographic photosensitive member thus manufactured was mounted on a test apparatus and was tested at a temperature of 32.5° C. and at a humidity of 80% RH. After a horizontal line image was continuously printed on 10,000 A4-size plain paper sheets at a printing ratio of 2%, a ghost test image shown in FIG. 2 was printed out. As illustrated in FIG. 2, the ghost test image had square "solid images" in a "white image" at the top of the image followed by a "1-dot Keima-pattern (similar to knight-jump pattern) halftone image" illustrated in FIG. 3. Ghosts due to the "solid images" could appear in the "ghost" regions in FIG. 2. On the basis of the image illustrated in FIG. 2, ghost images were classified into A: substantially no ghost, B: a few ghosts, and C: apparent ghosts. In Example 1, substantially no ghost image was observed after printing 10,000 sheets. Table 25 shows the results.

<Measurement of Ghost Potential>

The ghost potential was measured with the HP Color LaserJet 3700 manufactured by Hewlett-Packard Co. A process cartridge that included the electrophotographic photosensitive member was mounted on a test apparatus and was tested at a temperature of 32.5° C. and at a humidity of 80% RH. After a horizontal line image was continuously printed on 10,000 A4-size plain paper sheets at a printing ratio of 2%, the ghost potential was measured as described below. The ghost potential was measured with an electric potential measurement probe fixed with a jig disposed at 128 mm away from an end of the electrophotographic photosensitive member in the process cartridge (at the central portion). The jig replaced the developing unit. A bias was applied such that the dark area potential of an unexposed portion of the electrophotographic photosensitive member was −500 V. The laser beam intensity was 0.28 $\mu J/cm^2$. Signals for outputting the image illustrated in FIG. 2 were inputted to a test apparatus to measure the ghost potential. In response to the signals for outputting the image illustrated in FIG. 2, an electrostatic latent image corresponding to the image illustrated in FIG. 2 was formed on the surface of the photosensitive member. In the electrostatic latent image corresponding to the image illustrated in FIG. 2, the ghost potential was a difference in electric potential between a ghost image forming region in a halftone image forming region and the region other than the ghost image forming region in the halftone image forming region. In Example 1, the ghost potential was 5 V after printing 10,000 sheets. Table 25 shows the results.

<Measurement of Friction Coefficient>

The friction coefficients of the electrophotographic photosensitive members manufactured in the examples and comparative examples were measured by the following method. The friction coefficient was measured at normal temperature and humidity (23° C./50% RH) with HEIDON-14 manufactured by Shinto Scientific Co., Ltd. A blade (urethane rubber blade) was brought into contact with each of the electrophotographic photosensitive members at a constant load (50 g). The friction force between each of the electrophotographic photosensitive members and the rubber blade was measured while the electrophotographic photosensitive member was translated at a speed of 50 mm/min in the axial direction of the electrophotographic photosensitive member. The friction force was measured as a strain with a strain gauge attached to the urethane rubber blade and was converted into a tensile load (applied to the photosensitive member). The coefficient of kinetic friction was determined using the formula: [Force (friction force) applied to photosensitive member (gf)]/[Load applied to blade (gf)] while the urethane rubber blade was moving. The urethane rubber blade was a 5 mm×30 mm×2 mm urethane blade manufactured by Hokushin Corp. (rubber hardness 67 degrees). The measurement was performed at a load of 50 g in the "with" direction at an angle of 27 degrees. The friction coefficient in Example 1 was 1.0. Table 25 shows the results.

Examples 2 to 36

An electrophotographic photosensitive member was manufactured in the same manner as in Example 1 except that the types and amounts of constituent α, additional resin (resin E), constituent β, charge transporting substance, and solvent of the charge transporting layer were changed as shown in Table 16. The charge transporting layers in Examples 35 and 36 had a thickness of 10 and 25 μm, respectively. Table 25 shows the results.

Example 37

An electrophotographic photosensitive member was manufactured in the same manner as in Example 3 except that the drying condition after the charge transporting layer coating solution was applied to the charge generating layer by dip coating was 135° C. for 60 minutes. Table 25 shows the results.

Example 38

An electrophotographic photosensitive member was manufactured in the same manner as in Example 3 except that the drying condition after the charge transporting layer coating solution was applied to the charge generating layer by dip coating was 120° C. for 20 minutes. Table 25 shows the results.

TABLE 16

| | Constituent α | | Resin E | | Constituent β | | Charge transporting substance | | Solvent | |
|---|---|---|---|---|---|---|---|---|---|---|
| Example | Type | Parts | Type | Parts | Type | Parts | Type | Parts | Type | Parts |
| 1 | Resin PC-A(1) | 1 | Resin PC-E(2) | 9 | methyl benzoate | 10 | CTM-1 | 9 | THF | 65 |
| 2 | Resin PC-A(2) | 1 | Resin PC-E(2) | 9 | methyl benzoate | 10 | CTM-1 | 9 | THF | 65 |
| 3 | Resin PC-A(3) | 1 | Resin PC-E(2) | 9 | methyl benzoate | 10 | CTM-1 | 9 | THF | 65 |
| 4 | Resin PC-A(4) | 1 | Resin PC-E(2) | 9 | methyl benzoate | 10 | CTM-1 | 9 | THF | 65 |
| 5 | Resin PC-A(5) | 1 | Resin PC-E(2) | 9 | methyl benzoate | 10 | CTM-1 | 9 | THF | 65 |
| 6 | Resin PC-A(6) | 1 | Resin PC-E(2) | 9 | methyl benzoate | 10 | CTM-1 | 9 | THF | 65 |
| 7 | Resin PC-A(7) | 1 | Resin PC-E(2) | 9 | methyl benzoate | 10 | CTM-1 | 9 | THF | 65 |
| 8 | Resin PC-A(8) | 1 | Resin PC-E(2) | 9 | methyl benzoate | 10 | CTM-1 | 9 | THF | 65 |
| 9 | Resin PC-A(9) | 1 | Resin PC-E(2) | 9 | methyl benzoate | 10 | CTM-1 | 9 | THF | 65 |
| 10 | Resin PC-A(10) | 1 | Resin PC-E(2) | 9 | methyl benzoate | 10 | CTM-1 | 9 | THF | 65 |
| 11 | Resin PC-A(11) | 1 | Resin PC-E(2) | 9 | methyl benzoate | 10 | CTM-1 | 9 | THF | 65 |
| 12 | Resin PC-A(12) | 1 | Resin PC-E(2) | 9 | methyl benzoate | 10 | CTM-1 | 9 | THF | 65 |
| 13 | Resin PC-A(13) | 1 | Resin PC-E(2) | 9 | methyl benzoate | 10 | CTM-1 | 9 | THF | 65 |
| 14 | Resin PC-A(14) | 1 | Resin PC-E(2) | 9 | methyl benzoate | 10 | CTM-1 | 9 | THF | 65 |
| 15 | Resin PC-A(15) | 1 | Resin PC-E(2) | 9 | methyl benzoate | 10 | CTM-1 | 9 | THF | 65 |
| 16 | Resin PC-A(16) | 1 | Resin PC-E(2) | 9 | methyl benzoate | 10 | CTM-1 | 9 | THF | 65 |
| 17 | Resin PE-A(1) | 1 | Resin PE-E(3) | 9 | methyl benzoate | 10 | CTM-1 | 9 | THF | 65 |
| 18 | Resin PE-A(2) | 1 | Resin PE-E(3) | 9 | methyl benzoate | 10 | CTM-1 | 9 | THF | 65 |
| 19 | Resin PC-A(3) | 1 | Resin PC-E(2) | 9 | methyl benzoate | 2 | CTM-1 | 9 | THF | 65 |
| 20 | Resin PC-A(3) | 1 | Resin PC-E(2) | 9 | methyl benzoate | 15 | CTM-1 | 9 | THF | 65 |
| 21 | Resin PC-A(3) | 1 | Resin PC-E(2) | 9 | methyl benzoate | 10 | CTM-1 | 9 | THF/ toluene | 50/ 15 |
| 22 | Resin PC-A(3) | 1 | Resin PC-E(2) | 9 | cyclohexanol | 10 | CTM-1 | 9 | THF | 65 |
| 23 | Resin PC-A(3) | 1 | Resin PC-E(2) | 9 | benzyl alcohol | 10 | CTM-1 | 9 | THF | 65 |
| 24 | Resin PC-A(3) | 1 | Resin PC-E(2) | 9 | ethyl benzoate | 10 | CTM-1 | 9 | THF | 65 |
| 25 | Resin PC-A(3) | 1 | Resin PC-E(2) | 9 | benzyl acetate | 10 | CTM-1 | 9 | THF | 65 |
| 26 | Resin PC-A(3) | 1 | Resin PC-E(2) | 9 | ethyl 3-ethoxypropionate | 10 | CTM-1 | 9 | THF | 65 |
| 27 | Resin PC-A(3) | 1 | Resin PC-E(2) | 9 | acetophenone | 10 | CTM-1 | 9 | THF | 65 |
| 28 | Resin PC-A(3) | 1 | Resin PC-E(2) | 9 | methyl salicylate | 10 | CTM-1 | 9 | THF | 65 |
| 29 | Resin PC-A(3) | 1 | Resin PC-E(2) | 9 | dimethyl phthalate | 10 | CTM-1 | 9 | THF | 65 |
| 30 | Resin PC-A(3) | 0.2 | Resin PC-E(2) | 9.8 | methyl benzoate | 10 | CTM-1 | 9 | THF | 65 |
| 31 | Resin PC-A(3) | 9 | Resin PC-E(2) | 1 | methyl benzoate | 10 | CTM-1 | 9 | THF | 65 |
| 32 | Resin PC-A(3) | 1 | Resin PC-E(4) | 9 | methyl benzoate | 10 | CTM-9 | 9 | THF | 65 |
| 33 | Resin PC-A(3) | 1 | Resin PC-E(2) | 9 | methyl benzoate | 10 | CTM-2 | 9 | THF | 65 |
| 34 | Resin PC-A(3) | 1 | Resin PC-E(2) | 9 | methyl benzoate | 10 | CTM-3 | 9 | THF | 65 |
| 35 | Resin PC-A(3) | 1 | Resin PC-E(2) | 9 | methyl benzoate | 10 | CTM-1 | 9 | THF | 65 |
| 36 | Resin PC-A(3) | 1 | Resin PC-E(2) | 9 | methyl benzoate | 10 | CTM-1 | 9 | THF | 65 |
| 37 | Resin PC-A(3) | 1 | Resin PC-E(2) | 9 | methyl benzoate | 10 | CTM-1 | 9 | THF | 65 |
| 38 | Resin PC-A(3) | 1 | Resin PC-E(2) | 9 | methyl benzoate | 10 | CTM-1 | 9 | THF | 65 |

Examples 39 to 70

An electrophotographic photosensitive member was manufactured in the same manner as in Example 1 except that the types and amounts of constituent α, resin E, constituent β, charge transporting substance, and solvent of the charge transporting layer were changed as shown in Table 17. The charge transporting layers in Examples 69 and 70 had a thickness of 10 and 25 μm, respectively. Table 26 shows the results.

TABLE 17

| | Constituent α | | Resin E | | Constituent β | | Charge transporting substance | | Solvent | |
|---|---|---|---|---|---|---|---|---|---|---|
| Example | Type | Parts | Type | Parts | Type | Parts | Type | Parts | Type | Parts |
| 39 | Resin PC-B(1) | 1 | Resin PC-E(4) | 9 | methyl benzoate | 10 | CTM-9 | 9 | THF | 65 |
| 40 | Resin PC-B(2) | 1 | Resin PC-E(4) | 9 | methyl benzoate | 10 | CTM-9 | 9 | THF | 65 |
| 41 | Resin PC-B(3) | 1 | Resin PC-E(4) | 9 | methyl benzoate | 10 | CTM-9 | 9 | THF | 65 |
| 42 | Resin PC-B(4) | 1 | Resin PC-E(4) | 9 | methyl benzoate | 10 | CTM-9 | 9 | THF | 65 |
| 43 | Resin PC-B(5) | 1 | Resin PC-E(4) | 9 | methyl benzoate | 10 | CTM-9 | 9 | THF | 65 |
| 44 | Resin PC-B(6) | 1 | Resin PC-E(4) | 9 | methyl benzoate | 10 | CTM-9 | 9 | THF | 65 |
| 45 | Resin PC-B(7) | 1 | Resin PC-E(4) | 9 | methyl benzoate | 10 | CTM-9 | 9 | THF | 65 |
| 46 | Resin PC-B(8) | 1 | Resin PC-E(4) | 9 | methyl benzoate | 10 | CTM-9 | 9 | THF | 65 |
| 47 | Resin PC-B(9) | 1 | Resin PC-E(4) | 9 | methyl benzoate | 10 | CTM-9 | 9 | THF | 65 |
| 48 | Resin PC-B(10) | 1 | Resin PC-E(4) | 9 | methyl benzoate | 10 | CTM-9 | 9 | THF | 65 |
| 49 | Resin PC-B(11) | 1 | Resin PC-E(4) | 9 | methyl benzoate | 10 | CTM-9 | 9 | THF | 65 |
| 50 | Resin PC-B(12) | 1 | Resin PC-E(4) | 9 | methyl benzoate | 10 | CTM-9 | 9 | THF | 65 |
| 51 | Resin PC-B(13) | 1 | Resin PC-E(4) | 9 | methyl benzoate | 10 | CTM-9 | 9 | THF | 65 |
| 52 | Resin PC-B(14) | 1 | Resin PC-E(4) | 9 | methyl benzoate | 10 | CTM-9 | 9 | THF | 65 |
| 53 | Resin PE-B(1) | 1 | Resin PE-E(1) | 9 | methyl benzoate | 10 | CTM-9 | 9 | THF | 65 |
| 54 | Resin PE-B(2) | 1 | Resin PE-E(1) | 9 | methyl benzoate | 10 | CTM-9 | 9 | THF | 65 |
| 55 | Resin PC-B(3) | 1 | Resin PC-E(4) | 9 | methyl benzoate | 2 | CTM-9 | 9 | THF | 65 |
| 56 | Resin PC-B(3) | 1 | Resin PC-E(4) | 9 | methyl benzoate | 15 | CTM-9 | 9 | THF | 65 |
| 57 | Resin PC-B(3) | 1 | Resin PC-E(4) | 9 | methyl benzoate | 10 | CTM-9 | 9 | THF/ toluene | 50/ 15 |
| 58 | Resin PC-B(3) | 1 | Resin PC-E(4) | 9 | cyclohexanol | 10 | CTM-9 | 9 | THF | 65 |
| 59 | Resin PC-B(3) | 1 | Resin PC-E(4) | 9 | benzyl alcohol | 10 | CTM-9 | 9 | THF | 65 |
| 60 | Resin PC-B(3) | 1 | Resin PC-E(4) | 9 | ethyl benzoate | 10 | CTM-9 | 9 | THF | 65 |
| 61 | Resin PC-B(3) | 1 | Resin PC-E(4) | 9 | benzyl acetate | 10 | CTM-9 | 9 | THF | 65 |
| 62 | Resin PC-B(3) | 1 | Resin PC-E(4) | 9 | ethyl 3-ethoxypropionate | 10 | CTM-9 | 9 | THF | 65 |
| 63 | Resin PC-B(3) | 1 | Resin PC-E(4) | 9 | acetophenone | 10 | CTM-9 | 9 | THF | 65 |
| 64 | Resin PC-B(3) | 1 | Resin PC-E(4) | 9 | methyl salicylate | 10 | CTM-9 | 9 | THF | 65 |
| 65 | Resin PC-B(3) | 1 | Resin PC-E(4) | 9 | dimethyl phthalate | 10 | CTM-9 | 9 | THF | 65 |
| 66 | Resin PC-B(3) | 0.2 | Resin PC-E(4) | 9.8 | methyl benzoate | 10 | CTM-9 | 9 | THF | 65 |
| 67 | Resin PC-B(3) | 9 | Resin PC-E(4) | 1 | methyl benzoate | 10 | CTM-9 | 9 | THF | 65 |
| 68 | Resin PC-B(3) | 1 | Resin PC-E(6) | 9 | methyl benzoate | 10 | CTM-9 | 9 | THF | 65 |
| 69 | Resin PC-B(3) | 1 | Resin PC-E(4) | 9 | methyl benzoate | 10 | CTM-9 | 9 | THF | 65 |
| 70 | Resin PC-B(3) | 1 | Resin PC-E(4) | 9 | methyl benzoate | 10 | CTM-9 | 9 | THF | 65 |
| 71 | Resin PC-B(3) | 1 | Resin PC-E(4) | 9 | methyl benzoate | 10 | CTM-9 | 9 | THF | 65 |
| 72 | Resin PC-B(3) | 1 | Resin PC-E(4) | 9 | methyl benzoate | 10 | CTM-9 | 9 | THF | 65 |

Example 71

An electrophotographic photosensitive member was manufactured in the same manner as in Example 41 except that the drying condition after the charge transporting layer coating solution was applied to the charge generating layer by dip coating was 135° C. for 60 minutes. Table 26 shows the results.

Example 72

An electrophotographic photosensitive member was manufactured in the same manner as in Example 41 except that the drying condition after the charge transporting layer coating solution was applied to the charge generating layer by dip coating was 120° C. for 20 minutes. Table 26 shows the results.

Examples 73 to 120

An electrophotographic photosensitive member was manufactured in the same manner as in Example 1 except that the types and amounts of constituent α, resin E, constituent β, charge transporting substance, and solvent of the charge transporting layer were changed as shown in Table 18 or 19. The charge transporting layers in Examples 119 and 120 had a thickness of 10 and 25 μm, respectively. Tables 27 and 28 show the results.

TABLE 18

| | Constituent α | | Resin E | | Constituent β | | Charge transporting substance | | Solvent | |
|---|---|---|---|---|---|---|---|---|---|---|
| Example | Type | Parts | Type | Parts | Type | Parts | Type | Parts | Type | Parts |
| 73 | Resin PC-C(1) | 1 | Resin PC-E(6) | 9 | methyl benzoate | 10 | CTM-4/CTM-6 | 6/3 | THF | 65 |
| 74 | Resin PC-C(2) | 1 | Resin PC-E(6) | 9 | methyl benzoate | 10 | CTM-4/CTM-6 | 6/3 | THF | 65 |
| 75 | Resin PC-C(3) | 1 | Resin PC-E(6) | 9 | methyl benzoate | 10 | CTM-4/CTM-6 | 6/3 | THF | 65 |
| 76 | Resin PC-C(4) | 1 | Resin PC-E(6) | 9 | methyl benzoate | 10 | CTM-4/CTM-6 | 6/3 | THF | 65 |
| 77 | Resin PC-C(5) | 1 | Resin PC-E(6) | 9 | methyl benzoate | 10 | CTM-4/CTM-6 | 6/3 | THF | 65 |
| 78 | Resin PC-C(6) | 1 | Resin PC-E(6) | 9 | methyl benzoate | 10 | CTM-4/CTM-6 | 6/3 | THF | 65 |
| 79 | Resin PC-C(7) | 1 | Resin PC-E(6) | 9 | methyl benzoate | 10 | CTM-4/CTM-6 | 6/3 | THF | 65 |
| 80 | Resin PC-C(8) | 1 | Resin PC-E(6) | 9 | methyl benzoate | 10 | CTM-4/CTM-6 | 6/3 | THF | 65 |
| 81 | Resin PC-C(9) | 1 | Resin PC-E(6) | 9 | methyl benzoate | 10 | CTM-4/CTM-6 | 6/3 | THF | 65 |
| 82 | Resin PE-C(1) | 1 | Resin PE-E(5) | 9 | methyl benzoate | 10 | CTM-4/CTM-6 | 6/3 | THF | 65 |
| 83 | Resin PE-C(2) | 1 | Resin PE-E(5) | 9 | methyl benzoate | 10 | CTM-4/CTM-6 | 6/3 | THF | 65 |
| 84 | Resin PC-C(1) | 1 | Resin PC-E(6) | 9 | methyl benzoate | 2 | CTM-4/CTM-6 | 6/3 | THF | 65 |
| 85 | Resin PC-C(1) | 1 | Resin PC-E(6) | 9 | methyl benzoate | 15 | CTM-4/CTM-6 | 6/3 | THF | 65 |
| 86 | Resin PC-C(1) | 1 | Resin PC-E(6) | 9 | methyl benzoate | 25 | CTM-4/CTM-6 | 6/3 | THF | 65 |
| 87 | Resin PC-C(1) | 1 | Resin PC-E(6) | 9 | methyl benzoate | 10 | CTM-4/CTM-6 | 6/3 | THF/ toluene | 50/ 15 |
| 88 | Resin PC-C(1) | 1 | Resin PC-E(6) | 9 | cyclohexanol | 10 | CTM-4/CTM-6 | 6/3 | THF | 65 |
| 89 | Resin PC-C(1) | 1 | Resin PC-E(6) | 9 | benzyl alcohol | 10 | CTM-4/CTM-6 | 6/3 | THF | 65 |
| 90 | Resin PC-C(1) | 1 | Resin PC-E(6) | 9 | ethyl benzoate | 10 | CTM-4/CTM-6 | 6/3 | THF | 65 |
| 91 | Resin PC-C(1) | 1 | Resin PC-E(6) | 9 | benzyl acetate | 10 | CTM-4/CTM-6 | 6/3 | THF | 65 |
| 92 | Resin PC-C(1) | 1 | Resin PC-E(6) | 9 | ethyl 3-ethoxypropionate | 10 | CTM-4/CTM-6 | 6/3 | THF | 65 |
| 93 | Resin PC-C(1) | 1 | Resin PC-E(6) | 9 | acetophenone | 10 | CTM-4/CTM-6 | 6/3 | THF | 65 |
| 94 | Resin PC-C(1) | 1 | Resin PC-E(6) | 9 | methyl salicylate | 10 | CTM-4/CTM-6 | 6/3 | THF | 65 |
| 95 | Resin PC-C(1) | 1 | Resin PC-E(6) | 9 | dimethyl phthalate | 10 | CTM-4/CTM-6 | 6/3 | THF | 65 |
| 96 | Resin PC-C(1) | 1 | Resin PC-E(6) | 9 | hexanol | 10 | CTM-4/CTM-6 | 6/3 | THF | 65 |
| 97 | Resin PC-C(1) | 1 | Resin PC-E(6) | 9 | heptanol | 10 | CTM-4/CTM-6 | 6/3 | THF | 65 |
| 98 | Resin PC-C(1) | 1 | Resin PC-E(6) | 9 | ethylene glycol | 10 | CTM-4/CTM-6 | 6/3 | THF | 65 |

TABLE 19

| | Constituent α | | Resin E | | Constituent β | | Charge transporting substance | | Solvent | |
|---|---|---|---|---|---|---|---|---|---|---|
| Example | Type | Parts | Type | Parts | Type | Parts | Type | Parts | Type | Parts |
| 99 | Resin PC-C(1) | 1 | Resin PC-E(6) | 9 | 1,4-butanediol | 10 | CTM-4/CTM-6 | 6/3 | THF | 65 |
| 100 | Resin PC-C(1) | 1 | Resin PC-E(6) | 9 | 1,5-pentanediol | 10 | CTM-4/CTM-6 | 6/3 | THF | 65 |
| 101 | Resin PC-C(1) | 1 | Resin PC-E(6) | 9 | diethylene glycol | 10 | CTM-4/CTM-6 | 6/3 | THF | 65 |
| 102 | Resin PC-C(1) | 1 | Resin PC-E(6) | 9 | diethylene glycol ethyl methyl ether | 10 | CTM-4/CTM-6 | 6/3 | THF | 65 |
| 103 | Resin PC-C(1) | 1 | Resin PC-E(6) | 9 | ethylene carbonate | 10 | CTM-4/CTM-6 | 6/3 | THF | 65 |
| 104 | Resin PC-C(1) | 1 | Resin PC-E(6) | 9 | propylene carbonate | 10 | CTM-4/CTM-6 | 6/3 | THF | 65 |
| 105 | Resin PC-C(1) | 1 | Resin PC-E(6) | 9 | nitrobenzene | 10 | CTM-4/CTM-6 | 6/3 | THF | 65 |
| 106 | Resin PC-C(1) | 1 | Resin PC-E(6) | 9 | pyrrolidone | 10 | CTM-4/CTM-6 | 6/3 | THF | 65 |
| 107 | Resin PC-C(1) | 1 | Resin PC-E(6) | 9 | N-methylpyrrolidone | 10 | CTM-4/CTM-6 | 6/3 | THF | 65 |
| 108 | Resin PC-C(1) | 1 | Resin PC-E(6) | 9 | sulfolane | 10 | CTM-4/CTM-6 | 6/3 | THF | 65 |
| 109 | Resin PC-C(1) | 0.2 | Resin PC-E(6) | 9.8 | methyl benzoate | 10 | CTM-4/CTM-6 | 6/3 | THF | 65 |
| 110 | Resin PC-C(1) | 9 | Resin PC-E(6) | 1 | methyl benzoate | 10 | CTM-4/CTM-6 | 6/3 | THF | 65 |
| 111 | Resin PC-C(1) | 1 | Resin PC-E(6) | 9 | methyl benzoate | 10 | CTM-5/CTM-6 | 7/2 | THF | 65 |
| 112 | Resin PC-C(1) | 1 | Resin PC-E(6) | 9 | methyl benzoate | 10 | CTM-7 | 9 | THF | 65 |
| 113 | Resin PC-C(1) | 1 | Resin PC-E(6) | 9 | methyl benzoate | 10 | CTM-8 | 9 | THF | 65 |
| 114 | Resin PC-C(1) | 1 | Resin PC-E(6) | 9 | methyl benzoate | 10 | CTM-4/CTM-6 | 5/2 | THF | 65 |
| 115 | Resin PC-C(1) | 1 | Resin PC-E(1) | 9 | methyl benzoate | 10 | CTM-4/CTM-6 | 6/3 | THF | 65 |
| 116 | Resin PC-C(1) | 1 | Resin PC-E(3) | 9 | methyl benzoate | 10 | CTM-4/CTM-6 | 6/3 | THF | 65 |
| 117 | Resin PC-C(1) | 1 | Resin PC-E(6) | 9 | methyl benzoate | 10 | CTM-4/CTM-6 | 6/3 | THF | 80 |
| 118 | Resin PC-C(1) | 1 | Resin PC-E(6) | 9 | methyl benzoate | 10 | CTM-4/CTM-6 | 6/3 | THF | 100 |
| 119 | Resin PC-C(1) | 1 | Resin PC-E(6) | 9 | methyl benzoate | 10 | CTM-4/CTM-6 | 6/3 | THF | 65 |
| 120 | Resin PC-C(1) | 1 | Resin PC-E(6) | 9 | methyl benzoate | 10 | CTM-4/CTM-6 | 6/3 | THF | 65 |
| 121 | Resin PC-C(1) | 1 | Resin PC-E(6) | 9 | methyl benzoate | 10 | CTM-4/CTM-6 | 6/3 | THF | 65 |
| 122 | Resin PC-C(1) | 1 | Resin PC-E(6) | 9 | methyl benzoate | 10 | CTM-4/CTM-6 | 6/3 | THF | 65 |
| 123 | Resin PC-C(1) | 1 | Resin PC-E(6) | 9 | methyl benzoate | 10 | CTM-4/CTM-6 | 6/3 | THF | 65 |
| 124 | Resin PC-C(1) | 1 | Resin PC-E(6) | 9 | methyl benzoate | 10 | CTM-4/CTM-6 | 5/2 | THF | 65 |
| 125 | Resin PC-C(1) | 1 | Resin PC-E(6) | 9 | methyl benzoate | 10 | CTM-4/CTM-6 | 8/3 | THF | 65 |

Example 121

An electrophotographic photosensitive member was manufactured in the same manner as in Example 73 except that the drying condition after the charge transporting layer coating solution was applied to the charge generating layer by dip coating was 135° C. for 60 minutes. Table 28 shows the results.

Example 122

An electrophotographic photosensitive member was manufactured in the same manner as in Example 73 except that the drying condition after the charge transporting layer coating solution was applied to the charge generating layer by dip coating was 120° C. for 20 minutes. Table 28 shows the results.

Example 123

An electrophotographic photosensitive member was manufactured in the same manner as in Example 73 except that the drying condition after the charge transporting layer coating solution was applied to the charge generating layer by dip coating was 115° C. for 20 minutes. Table 28 shows the results.

Examples 124 to 152

An electrophotographic photosensitive member was manufactured in the same manner as in Example 1 except that the types and amounts of constituent α, resin E, constituent β, charge transporting substance, and solvent of the charge transporting layer were changed as shown in Table 20. The charge transporting layers in Examples 151 and 152 had a thickness of 10 and 25 μm, respectively. Table 29 shows the results.

TABLE 20

| | Constituent α | | Resin E | | Constituent β | | Charge transporting substance | | Solvent | |
|---|---|---|---|---|---|---|---|---|---|---|
| Example | Type | Parts | Type | Parts | Type | Parts | Type | Parts | Type | Parts |
| 126 | Resin PC-D(1) | 1 | Resin PC-E(4) | 9 | methyl benzoate | 10 | CTM-6 | 9 | THF | 65 |
| 127 | Resin PC-D(2) | 1 | Resin PC-E(4) | 9 | methyl benzoate | 10 | CTM-6 | 9 | THF | 65 |
| 128 | Resin PC-D(3) | 1 | Resin PC-E(4) | 9 | methyl benzoate | 10 | CTM-6 | 9 | THF | 65 |
| 129 | Resin PC-D(4) | 1 | Resin PC-E(4) | 9 | methyl benzoate | 10 | CTM-6 | 9 | THF | 65 |
| 130 | Resin PC-D(5) | 1 | Resin PC-E(4) | 9 | methyl benzoate | 10 | CTM-6 | 9 | THF | 65 |
| 131 | Resin PC-D(7) | 1 | Resin PC-E(4) | 9 | methyl benzoate | 10 | CTM-6 | 9 | THF | 65 |
| 132 | Resin PC-D(8) | 1 | Resin PC-E(4) | 9 | methyl benzoate | 10 | CTM-6 | 9 | THF | 65 |
| 133 | Resin PC-D(9) | 1 | Resin PC-E(4) | 9 | methyl benzoate | 10 | CTM-6 | 9 | THF | 65 |
| 134 | Resin PC-D(10) | 1 | Resin PC-E(4) | 9 | methyl benzoate | 10 | CTM-6 | 9 | THF | 65 |
| 135 | Resin PC-D(11) | 1 | Resin PC-E(4) | 9 | methyl benzoate | 10 | CTM-6 | 9 | THF | 65 |
| 136 | Resin PE-D(1) | 1 | Resin PC-E(4) | 9 | methyl benzoate | 10 | CTM-6 | 9 | THF | 65 |
| 137 | Resin PE-D(2) | 1 | Resin PC-E(4) | 9 | methyl benzoate | 10 | CTM-6 | 9 | THF | 65 |
| 138 | Resin PE-D(3) | 1 | Resin PC-E(4) | 9 | methyl benzoate | 10 | CTM-6 | 9 | THF | 65 |
| 139 | Resin PC-D(1) | 1 | Resin PC-E(4) | 9 | methyl benzoate | 2 | CTM-6 | 9 | THF | 65 |
| 140 | Resin PC-D(1) | 1 | Resin PC-E(4) | 9 | methyl benzoate | 15 | CTM-6 | 9 | THF | 65 |
| 141 | Resin PC-D(1) | 1 | Resin PC-E(4) | 9 | methyl benzoate | 10 | CTM-6 | 9 | THF/ toluene | 50/ 15 |
| 142 | Resin PC-D(1) | 1 | Resin PC-E(4) | 9 | cyclohexanol | 10 | CTM-6 | 9 | THF | 65 |
| 143 | Resin PC-D(1) | 1 | Resin PC-E(4) | 9 | benzyl alcohol | 10 | CTM-6 | 9 | THF | 65 |
| 144 | Resin PC-D(1) | 1 | Resin PC-E(4) | 9 | ethyl benzoate | 10 | CTM-6 | 9 | THF | 65 |
| 145 | Resin PC-D(1) | 1 | Resin PC-E(4) | 9 | benzyl acetate | 10 | CTM-6 | 9 | THF | 65 |
| 146 | Resin PC-D(1) | 1 | Resin PC-E(4) | 9 | ethyl 3-ethoxypropionate | 10 | CTM-6 | 9 | THF | 65 |
| 147 | Resin PC-D(1) | 1 | Resin PC-E(4) | 9 | acetophenone | 10 | CTM-6 | 9 | THF | 65 |
| 148 | Resin PC-D(1) | 1 | Resin PC-E(4) | 9 | methyl salicylate | 10 | CTM-6 | 9 | THF | 65 |
| 149 | Resin PC-D(1) | 1 | Resin PC-E(4) | 9 | dimethyl phthalate | 10 | CTM-6 | 9 | THF | 65 |
| 150 | Resin PC-D(1) | 0.2 | Resin PC-E(4) | 9.8 | methyl benzoate | 10 | CTM-6 | 9 | THF | 65 |
| 151 | Resin PC-D(1) | 9 | Resin PC-E(4) | 1 | methyl benzoate | 10 | CTM-6 | 9 | THF | 65 |
| 152 | Resin PC-D(1) | 1 | Resin PC-E(5) | 9 | methyl benzoate | 10 | CTM-6 | 9 | THF | 65 |
| 153 | Resin PC-D(1) | 1 | Resin PC-E(4) | 9 | methyl benzoate | 10 | CTM-6 | 9 | THF | 65 |
| 154 | Resin PC-D(1) | 1 | Resin PC-E(4) | 9 | methyl benzoate | 10 | CTM-6 | 9 | THF | 65 |
| 155 | Resin PC-D(1) | 1 | Resin PC-E(4) | 9 | methyl benzoate | 10 | CTM-6 | 9 | THF | 65 |
| 156 | Resin PC-D(1) | 1 | Resin PC-E(4) | 9 | methyl benzoate | 10 | CTM-6 | 9 | THF | 65 |

Example 153

An electrophotographic photosensitive member was manufactured in the same manner as in Example 124 except that the drying condition after the charge transporting layer coating solution was applied to the charge generating layer by dip coating was 135° C. for 60 minutes. Table 29 shows the results.

Example 154

An electrophotographic photosensitive member was manufactured in the same manner as in Example 124 except that the drying condition after the charge transporting layer coating solution was applied to the charge generating layer by dip coating was 120° C. for 20 minutes. Table 29 shows the results.

Comparative Examples 1 to 29

An electrophotographic photosensitive member was manufactured in the same manner as in Example 1 except that the types and amounts of constituent α, resin E, comparative compound of the constituent β, charge transporting substance, and solvent of the charge transporting layer were changed as shown in Table 21. The charge transporting layers in Comparative Examples 28 and 29 had a thickness of 10 and 25 μm, respectively. Table 30 shows the results. In Comparative Examples 20 to 22, the monoglyme (Comparative Example 20), n-pentyl acetate (Comparative Example 21), and 1-pentanol (Comparative Example 22) contents of the surface layer were 0.002%, 0.040%, and 0.030% by mass, respectively.

Comparative Example 30

An electrophotographic photosensitive member was manufactured in the same manner as in Comparative Example 3 except that the drying condition after the charge transporting layer coating solution was applied to the charge generating layer by dip coating was 135° C. for 60 minutes. Table 30 shows the results.

Comparative Example 31

An electrophotographic photosensitive member was manufactured in the same manner as in Comparative Example 3 except that the drying condition after the charge transporting layer coating solution was applied to the charge generating layer by dip coating was 120° C. for 20 minutes. Table 30 shows the results.

Comparative Examples 32 to 56

An electrophotographic photosensitive member was manufactured in the same manner as in Example 1 except that the types and amounts of constituent α, resin E, comparative compound of the constituent β, charge transporting substance, and solvent of the charge transporting layer were changed as shown in Table 22. The charge transporting layers in Comparative Examples 55 and 56 had a thickness of 10 and 25 μm, respectively. Table 30 shows the results. In Comparative Examples 49 to 51, the monoglyme (Comparative Example 49), n-pentyl acetate (Comparative Example 50), and 1-pentanol (Comparative Example 51) contents of the surface layer were 0.005%, 0.040%, and 0.040% by mass, respectively.

Comparative Example 57

An electrophotographic photosensitive member was manufactured in the same manner as in Comparative Example 34 except that the drying condition after the charge transporting layer coating solution was applied to the charge generating layer by dip coating was 135° C. for 60 minutes. Table 30 shows the results.

Comparative Example 58

An electrophotographic photosensitive member was manufactured in the same manner as in Comparative Example 34 except that the drying condition after the charge transporting layer coating solution was applied to the charge generating layer by dip coating was 120° C. for 20 minutes. Table 30 shows the results.

TABLE 21

| Comparative | Constituent α | | Resin E | | Comparative compound | | Charge transporting substance | | Solvent | |
|---|---|---|---|---|---|---|---|---|---|---|
| Example | Type | Parts | Type | Parts | Type | Parts | Type | Parts | Type | Parts |
| 1 | Resin PC-A(1) | 1 | Resin PC-E(2) | 9 | | | CTM-1 | 9 | THF | 65 |
| 2 | Resin PC-A(2) | 1 | Resin PC-E(2) | 9 | | | CTM-1 | 9 | THF | 65 |
| 3 | Resin PC-A(3) | 1 | Resin PC-E(2) | 9 | | | CTM-1 | 9 | THF | 65 |
| 4 | Resin PC-A(4) | 1 | Resin PC-E(2) | 9 | | | CTM-1 | 9 | THF | 65 |
| 5 | Resin PC-A(5) | 1 | Resin PC-E(2) | 9 | | | CTM-1 | 9 | THF | 65 |
| 6 | Resin PC-A(6) | 1 | Resin PC-E(2) | 9 | | | CTM-1 | 9 | THF | 65 |
| 7 | Resin PC-A(7) | 1 | Resin PC-E(2) | 9 | | | CTM-1 | 9 | THF | 65 |
| 8 | Resin PC-A(8) | 1 | Resin PC-E(2) | 9 | | | CTM-1 | 9 | THF | 65 |
| 9 | Resin PC-A(9) | 1 | Resin PC-E(2) | 9 | | | CTM-1 | 9 | THF | 65 |
| 10 | Resin PC-A(10) | 1 | Resin PC-E(2) | 9 | | | CTM-1 | 9 | THF | 65 |
| 11 | Resin PC-A(11) | 1 | Resin PC-E(2) | 9 | | | CTM-1 | 9 | THF | 65 |
| 12 | Resin PC-A(12) | 1 | Resin PC-E(2) | 9 | | | CTM-1 | 9 | THF | 65 |
| 13 | Resin PC-A(13) | 1 | Resin PC-E(2) | 9 | | | CTM-1 | 9 | THF | 65 |
| 14 | Resin PC-A(14) | 1 | Resin PC-E(2) | 9 | | | CTM-1 | 9 | THF | 65 |
| 15 | Resin PC-A(15) | 1 | Resin PC-E(2) | 9 | | | CTM-1 | 9 | THF | 65 |
| 16 | Resin PC-A(16) | 1 | Resin PC-E(2) | 9 | | | CTM-1 | 9 | THF | 65 |
| 17 | Resin PE-A(1) | 1 | Resin PE-E(3) | 9 | | | CTM-1 | 9 | THF | 65 |
| 18 | Resin PE-A(2) | 1 | Resin PE-E(3) | 9 | | | CTM-1 | 9 | THF | 65 |
| 19 | Resin PC-A(3) | 1 | Resin PC-E(2) | 9 | | | CTM-1 | 9 | THF/ toluene | 50/ 15 |
| 20 | Resin PC-A(3) | 1 | Resin PC-E(2) | 9 | monoglyme | 10 | CTM-1 | 9 | THF | 65 |
| 21 | Resin PC-A(3) | 1 | Resin PC-E(2) | 9 | n-pentyl acetate | 10 | CTM-1 | 9 | THF | 65 |
| 22 | Resin PC-A(3) | 1 | Resin PC-E(2) | 9 | 1-pentanol | 10 | CTM-1 | 9 | THF | 65 |
| 23 | Resin PC-A(3) | 0.2 | Resin PC-E(2) | 9.8 | | | CTM-1 | 9 | THF | 65 |
| 24 | Resin PC-A(3) | 9 | Resin PC-E(2) | 1 | | | CTM-1 | 9 | THF | 65 |
| 25 | Resin PC-A(3) | 1 | Resin PC-E(4) | 9 | | | CTM-9 | 9 | THF | 65 |
| 26 | Resin PC-A(3) | 1 | Resin PC-E(2) | 9 | | | CTM-2 | 9 | THF | 65 |
| 27 | Resin PC-A(3) | 1 | Resin PC-E(2) | 9 | | | CTM-3 | 9 | THF | 65 |
| 28 | Resin PC-A(3) | 1 | Resin PC-E(2) | 9 | | | CTM-1 | 9 | THF | 65 |
| 29 | Resin PC-A(3) | 1 | Resin PC-E(2) | 9 | | | CTM-1 | 9 | THF | 65 |
| 30 | Resin PC-A(3) | 1 | Resin PC-E(2) | 9 | | | CTM-1 | 9 | THF | 65 |
| 31 | Resin PC-A(3) | 1 | Resin PC-E(2) | 9 | | | CTM-1 | 9 | THF | 65 |

TABLE 22

| Comparative | Constituent α | | Resin E | | Comparative compound | | Charge transporting substance | | Solvent | |
|---|---|---|---|---|---|---|---|---|---|---|
| Example | Type | Parts | Type | Parts | Type | Parts | Type | Parts | Type | Parts |
| 32 | Resin PC-B(1) | 1 | Resin PC-E(4) | 9 | | | CTM-9 | 9 | THF | 65 |
| 33 | Resin PC-B(2) | 1 | Resin PC-E(4) | 9 | | | CTM-9 | 9 | THF | 65 |
| 34 | Resin PC-B(3) | 1 | Resin PC-E(4) | 9 | | | CTM-9 | 9 | THF | 65 |
| 35 | Resin PC-B(4) | 1 | Resin PC-E(4) | 9 | | | CTM-9 | 9 | THF | 65 |
| 36 | Resin PC-B(5) | 1 | Resin PC-E(4) | 9 | | | CTM-9 | 9 | THF | 65 |
| 37 | Resin PC-B(6) | 1 | Resin PC-E(4) | 9 | | | CTM-9 | 9 | THF | 65 |
| 38 | Resin PC-B(7) | 1 | Resin PC-E(4) | 9 | | | CTM-9 | 9 | THF | 65 |
| 39 | Resin PC-B(8) | 1 | Resin PC-E(4) | 9 | | | CTM-9 | 9 | THF | 65 |
| 40 | Resin PC-B(9) | 1 | Resin PC-E(4) | 9 | | | CTM-9 | 9 | THF | 65 |
| 41 | Resin PC-B(10) | 1 | Resin PC-E(4) | 9 | | | CTM-9 | 9 | THF | 65 |
| 42 | Resin PC-B(11) | 1 | Resin PC-E(4) | 9 | | | CTM-9 | 9 | THF | 65 |
| 43 | Resin PC-B(12) | 1 | Resin PC-E(4) | 9 | | | CTM-9 | 9 | THF | 65 |
| 44 | Resin PC-B(13) | 1 | Resin PC-E(4) | 9 | | | CTM-9 | 9 | THF | 65 |
| 45 | Resin PC-B(14) | 1 | Resin PC-E(4) | 9 | | | CTM-9 | 9 | THF | 65 |
| 46 | Resin PE-B(1) | 1 | Resin PE-E(1) | 9 | | | CTM-9 | 9 | THF | 65 |
| 47 | Resin PE-B(2) | 1 | Resin PE-E(1) | 9 | | | CTM-9 | 9 | THF | 65 |
| 48 | Resin PC-B(3) | 1 | Resin PC-E(4) | 9 | | | CTM-9 | 9 | THF/ toluene | 50/ 15 |
| 49 | Resin PC-B(3) | 1 | Resin PC-E(4) | 9 | monoglyme | 10 | CTM-9 | 9 | THF | 65 |
| 50 | Resin PC-B(3) | 1 | Resin PC-E(4) | 9 | n-pentyl acetate | 10 | CTM-9 | 9 | THF | 65 |
| 51 | Resin PC-B(3) | 1 | Resin PC-E(4) | 9 | 1-pentanol | 10 | CTM-9 | 9 | THF | 65 |
| 52 | Resin PC-B(3) | 0.2 | Resin PC-E(4) | 9.8 | | | CTM-9 | 9 | THF | 65 |
| 53 | Resin PC-B(3) | 9 | Resin PC-E(4) | 1 | | | CTM-9 | 9 | THF | 65 |
| 54 | Resin PC-B(3) | 1 | Resin PC-E(6) | 9 | | | CTM-9 | 9 | THF | 65 |
| 55 | Resin PC-B(3) | 1 | Resin PC-E(4) | 9 | | | CTM-9 | 9 | THF | 65 |
| 56 | Resin PC-B(3) | 1 | Resin PC-E(4) | 9 | | | CTM-9 | 9 | THF | 65 |
| 57 | Resin PC-B(3) | 1 | Resin PC-E(4) | 9 | | | CTM-9 | 9 | THF | 65 |
| 58 | Resin PC-B(3) | 1 | Resin PC-E(4) | 9 | | | CTM-9 | 9 | THF | 65 |

Comparative Examples 59 to 86

An electrophotographic photosensitive member was manufactured in the same manner as in Example 1 except that the types and amounts of constituent α, resin E, comparative compound of the constituent β, charge transporting substance, and solvent of the charge transporting layer were changed as shown in Table 23. The charge transporting layers in Comparative Examples 85 and 86 had a thickness of 10 and 25 μm, respectively. Table 31 shows the results. In Comparative Examples 71 to 73, the monoglyme (Comparative Example 71), n-pentyl acetate (Comparative Example 72), and 1-pentanol (Comparative Example 73) contents of the surface layer were 0.003%, 0.040%, and 0.050% by mass, respectively.

Comparative Example 87

An electrophotographic photosensitive member was manufactured in the same manner as in Comparative Example 59 except that the drying condition after the charge transporting layer coating solution was applied to the charge generating layer by dip coating was 135° C. for 60 minutes. Table 31 shows the results.

Comparative Example 88

An electrophotographic photosensitive member was manufactured in the same manner as in Comparative Example 59 except that the drying condition after the charge transporting layer coating solution was applied to the charge generating layer by dip coating was 120° C. for 20 minutes. Table 31 shows the results.

TABLE 23

| Comparative | Constituent α | | Resin E | | Comparative compound | | Charge transporting substance | | Solvent | |
|---|---|---|---|---|---|---|---|---|---|---|
| Example | Type | Parts | Type | Parts | Type | Parts | Type | Parts | Type | Parts |
| 59 | Resin PC-C(1) | 1 | Resin PC-E(6) | 9 | | | CTM-4/CTM-6 | 6/3 | THF | 65 |
| 60 | Resin PC-C(2) | 1 | Resin PC-E(6) | 9 | | | CTM-4/CTM-6 | 6/3 | THF | 65 |
| 61 | Resin PC-C(3) | 1 | Resin PC-E(6) | 9 | | | CTM-4/CTM-6 | 6/3 | THF | 65 |
| 62 | Resin PC-C(4) | 1 | Resin PC-E(6) | 9 | | | CTM-4/CTM-6 | 6/3 | THF | 65 |
| 63 | Resin PC-C(5) | 1 | Resin PC-E(6) | 9 | | | CTM-4/CTM-6 | 6/3 | THF | 65 |
| 64 | Resin PC-C(6) | 1 | Resin PC-E(6) | 9 | | | CTM-4/CTM-6 | 6/3 | THF | 65 |
| 65 | Resin PC-C(7) | 1 | Resin PC-E(6) | 9 | | | CTM-4/CTM-6 | 6/3 | THF | 65 |
| 66 | Resin PC-C(8) | 1 | Resin PC-E(6) | 9 | | | CTM-4/CTM-6 | 6/3 | THF | 65 |
| 67 | Resin PC-C(9) | 1 | Resin PC-E(6) | 9 | | | CTM-4/CTM-6 | 6/3 | THF | 65 |
| 68 | Resin PE-C(1) | 1 | Resin PE-E(5) | 9 | | | CTM-4/CTM-6 | 6/3 | THF | 65 |
| 69 | Resin PE-C(2) | 1 | Resin PE-E(5) | 9 | | | CTM-4/CTM-6 | 6/3 | THF | 65 |
| 70 | Resin PC-C(1) | 1 | Resin PC-E(6) | 9 | | | CTM-4/CTM-6 | 6/3 | THF/ toluene | 50/ 15 |
| 71 | Resin PC-B(3) | 1 | Resin PC-E(4) | 9 | monoglyme | 10 | CTM-9 | 9 | THF | 65 |
| 72 | Resin PC-B(3) | 1 | Resin PC-E(4) | 9 | n-pentyl acetate | 10 | CTM-9 | 9 | THF | 65 |
| 73 | Resin PC-B(3) | 1 | Resin PC-E(4) | 9 | 1-pentanol | 10 | CTM-9 | 9 | THF | 65 |

TABLE 23-continued

| Comparative | Constituent α | | Resin E | | Comparative compound | | Charge transporting substance | | Solvent | |
|---|---|---|---|---|---|---|---|---|---|---|
| Example | Type | Parts | Type | Parts | Type | Parts | Type | Parts | Type | Parts |
| 74 | Resin PC-C(1) | 0.2 | Resin PC-E(6) | 9.8 | | | CTM-4/CTM-6 | 6/3 | THF | 65 |
| 75 | Resin PC-C(1) | 9 | Resin PC-E(6) | 1 | | | CTM-4/CTM-6 | 6/3 | THF | 65 |
| 76 | Resin PC-C(1) | 1 | Resin PC-E(6) | 9 | | | CTM-5/CTM-6 | 7/2 | THF | 65 |
| 77 | Resin PC-C(1) | 1 | Resin PC-E(6) | 9 | | | CTM-7 | 9 | THF | 65 |
| 78 | Resin PC-C(1) | 1 | Resin PC-E(6) | 9 | | | CTM-8 | 9 | THF | 65 |
| 79 | Resin PC-C(1) | 1 | Resin PC-E(6) | 9 | | | CTM-4/CTM-6 | 5/2 | THF | 65 |
| 80 | Resin PC-C(1) | 1 | Resin PC-E(1) | 9 | | | CTM-4/CTM-6 | 6/3 | THF | 65 |
| 81 | Resin PC-C(1) | 1 | Resin PC-E(3) | 9 | | | CTM-4/CTM-6 | 6/3 | THF | 65 |
| 82 | Resin PC-C(1) | 1 | Resin PC-E(6) | 9 | | | CTM-4/CTM-6 | 6/3 | THF | 80 |
| 83 | Resin PC-C(1) | 1 | Resin PC-E(6) | 9 | | | CTM-4/CTM-6 | 6/3 | THF | 100 |
| 84 | Resin PC-C(1) | 1 | Resin PC-E(6) | 9 | | | CTM-4/CTM-6 | 6/3 | THF | 65 |
| 85 | Resin PC-C(1) | 1 | Resin PC-E(6) | 9 | | | CTM-4/CTM-6 | 6/3 | THF | 65 |
| 86 | Resin PC-C(1) | 1 | Resin PC-E(6) | 9 | | | CTM-4/CTM-6 | 6/3 | THF | 65 |
| 87 | Resin PC-C(1) | 1 | Resin PC-E(6) | 9 | | | CTM-4/CTM-6 | 6/3 | THF | 65 |
| 88 | Resin PC-C(1) | 1 | Resin PC-E(6) | 9 | | | CTM-4/CTM-6 | 6/3 | THF | 65 |

Comparative Examples 89 to 110

An electrophotographic photosensitive member was manufactured in the same manner as in Example 1 except that the types and amounts of constituent α, resin E, comparative compound of the constituent β, charge transporting substance, and solvent of the charge transporting layer were changed as shown in Table 24. The charge transporting layers in Comparative Examples 109 and 110 had a thickness of 10 and 25 μm, respectively. Table 31 shows the results. In Comparative Examples 103 to 105, the monoglyme (Comparative Example 103), n-pentyl acetate (Comparative Example 104), and 1-pentanol (Comparative Example 105) contents of the surface layer were 0.003%, 0.050%, and 0.030% by mass, respectively.

Comparative Example 111

An electrophotographic photosensitive member was manufactured in the same manner as in Comparative Example 89 except that the drying condition after the charge transporting layer coating solution was applied to the charge generating layer by dip coating was 135° C. for 60 minutes. Table 31 shows the results.

Comparative Example 112

An electrophotographic photosensitive member was manufactured in the same manner as in Comparative Example 89 except that the drying condition after the charge transporting layer coating solution was applied to the charge generating layer by dip coating was 120° C. for 20 minutes. Table 31 shows the results.

TABLE 24

| Comparative | Constituent α | | Resin E | | Comparative compound | | Charge transporting substance | | Solvent | |
|---|---|---|---|---|---|---|---|---|---|---|
| Example | Type | Parts | Type | Parts | Type | Parts | Type | Parts | Type | Parts |
| 89 | Resin PC-D(1) | 1 | Resin PC-E(4) | 9 | | | CTM-6 | 9 | THF | 65 |
| 90 | Resin PC-D(2) | 1 | Resin PC-E(4) | 9 | | | CTM-6 | 9 | THF | 65 |
| 91 | Resin PC-D(3) | 1 | Resin PC-E(4) | 9 | | | CTM-6 | 9 | THF | 65 |
| 92 | Resin PC-D(4) | 1 | Resin PC-E(4) | 9 | | | CTM-6 | 9 | THF | 65 |
| 93 | Resin PC-D(5) | 1 | Resin PC-E(4) | 9 | | | CTM-6 | 9 | THF | 65 |
| 94 | Resin PC-D(7) | 1 | Resin PC-E(4) | 9 | | | CTM-6 | 9 | THF | 65 |
| 95 | Resin PC-D(8) | 1 | Resin PC-E(4) | 9 | | | CTM-6 | 9 | THF | 65 |
| 96 | Resin PC-D(9) | 1 | Resin PC-E(4) | 9 | | | CTM-6 | 9 | THF | 65 |
| 97 | Resin PC-D(10) | 1 | Resin PC-E(4) | 9 | | | CTM-6 | 9 | THF | 65 |
| 98 | Resin PC-D(11) | 1 | Resin PC-E(4) | 9 | | | CTM-6 | 9 | THF | 65 |
| 99 | Resin PE-D(1) | 1 | Resin PC-E(4) | 9 | | | CTM-6 | 9 | THF | 65 |
| 100 | Resin PE-D(2) | 1 | Resin PC-E(4) | 9 | | | CTM-6 | 9 | THF | 65 |
| 101 | Resin PE-D(3) | 1 | Resin PC-E(4) | 9 | | | CTM-6 | 9 | THF | 65 |
| 102 | Resin PC-D(1) | 1 | Resin PC-E(4) | 9 | | | CTM-6 | 9 | THF/ toluene | 50/ 15 |
| 103 | Resin PC-D(1) | 1 | Resin PC-E(4) | 9 | monoglyme | 10 | CTM-6 | 9 | THF | 65 |
| 104 | Resin PC-D(1) | 1 | Resin PC-E(4) | 9 | n-pentyl acetate | 10 | CTM-6 | 9 | THF | 65 |
| 105 | Resin PC-D(1) | 1 | Resin PC-E(4) | 9 | 1-pentanol | 10 | CTM-6 | 9 | THF | 65 |
| 106 | Resin PC-D(1) | 0.2 | Resin PC-E(4) | 9.8 | | | CTM-6 | 9 | THF | 65 |
| 107 | Resin PC-D(1) | 9 | Resin PC-E(4) | 1 | | | CTM-6 | 9 | THF | 65 |
| 108 | Resin PC-D(1) | 1 | Resin PC-E(5) | 9 | | | CTM-6 | 9 | THF | 65 |
| 109 | Resin PC-D(1) | 1 | Resin PC-E(4) | 9 | | | CTM-6 | 9 | THF | 65 |
| 110 | Resin PC-D(1) | 1 | Resin PC-E(4) | 9 | | | CTM-6 | 9 | THF | 65 |
| 111 | Resin PC-D(1) | 1 | Resin PC-E(4) | 9 | | | CTM-6 | 9 | THF | 65 |
| 112 | Resin PC-D(1) | 1 | Resin PC-E(4) | 9 | | | CTM-6 | 9 | THF | 65 |

TABLE 25

| Example | Kinetic friction coefficient | Ghost image | Ghost electric potential (V) | β content (% by mass) | Relative to comparative example: Decrease in kinetic friction coefficient | Decrease in ghost potential | Corresponding comparative example |
|---|---|---|---|---|---|---|---|
| 1 | 1.0 | A | 5 | 0.120% | 0.2 | 10 | 1 |
| 2 | 1.0 | A | 6 | 0.140% | 0.3 | 4 | 2 |
| 3 | 0.9 | A | 5 | 0.100% | 0.3 | 5 | 3 |
| 4 | 1.1 | A | 4 | 0.110% | 0.3 | 11 | 4 |
| 5 | 1.0 | A | 5 | 0.120% | 0.3 | 5 | 5 |
| 6 | 0.9 | A | 5 | 0.100% | 0.3 | 7 | 6 |
| 7 | 1.0 | A | 4 | 0.100% | 0.2 | 10 | 7 |
| 8 | 1.1 | A | 5 | 0.100% | 0.3 | 7 | 8 |
| 9 | 0.8 | A | 4 | 0.130% | 0.2 | 6 | 9 |
| 10 | 1.0 | A | 5 | 0.110% | 0.3 | 9 | 10 |
| 11 | 0.9 | A | 6 | 0.100% | 0.2 | 9 | 11 |
| 12 | 1.0 | A | 5 | 0.140% | 0.3 | 5 | 12 |
| 13 | 0.9 | A | 5 | 0.120% | 0.2 | 9 | 13 |
| 14 | 1.0 | A | 4 | 0.140% | 0.3 | 8 | 14 |
| 15 | 1.4 | A | 5 | 0.120% | 0.4 | 4 | 15 |
| 16 | 0.6 | B | 1 | 0.110% | 0.2 | 12 | 16 |
| 17 | 0.9 | A | 6 | 0.120% | 0.2 | 4 | 17 |
| 18 | 0.9 | A | 5 | 0.110% | 0.2 | 6 | 18 |
| 19 | 1.1 | A | 7 | 0.010% | 0.1 | 3 | 3 |
| 20 | 0.9 | A | 3 | 0.140% | 0.3 | 7 | 3 |
| 21 | 0.9 | A | 5 | 0.110% | 0.3 | 5 | 19 |
| 22 | 1.0 | A | 5 | 0.080% | 0.2 | 5 | 3 |
| 23 | 0.9 | A | 4 | 0.110% | 0.3 | 6 | 3 |
| 24 | 0.9 | A | 5 | 0.120% | 0.3 | 5 | 3 |
| 25 | 1.0 | A | 5 | 0.110% | 0.2 | 5 | 3 |
| 26 | 1.0 | A | 5 | 0.080% | 0.2 | 5 | 3 |
| 27 | 1.0 | A | 4 | 0.100% | 0.2 | 6 | 3 |
| 28 | 0.9 | A | 5 | 0.130% | 0.3 | 5 | 3 |
| 29 | 0.9 | A | 4 | 0.150% | 0.3 | 6 | 3 |
| 30 | 1.7 | A | 5 | 0.100% | 0.3 | 2 | 23 |
| 31 | 0.7 | A | 5 | 0.120% | 0.3 | 15 | 24 |
| 32 | 0.9 | A | 6 | 0.100% | 0.2 | 9 | 25 |
| 33 | 0.9 | A | 4 | 0.110% | 0.2 | 10 | 26 |
| 34 | 0.9 | A | 5 | 0.100% | 0.2 | 10 | 27 |
| 35 | 0.9 | A | 6 | 0.090% | 0.2 | 8 | 28 |
| 36 | 1.0 | A | 5 | 0.110% | 0.2 | 5 | 29 |
| 37 | 0.9 | B | 9 | 0.001% | 0.2 | 2 | 30 |
| 38 | 0.9 | A | 3 | 2.000% | 0.2 | 5 | 31 |

TABLE 26

| Example | Kinetic friction coefficient | Ghost image | Ghost electric potential (V) | β content (% by mass) | Relative to comparative example: Decrease in kinetic friction coefficient | Decrease in ghost potential | Corresponding comparative example |
|---|---|---|---|---|---|---|---|
| 39 | 1.1 | A | 5 | 0.140% | 0.2 | 11 | 32 |
| 40 | 1.0 | A | 6 | 0.130% | 0.3 | 8 | 33 |
| 41 | 1.0 | A | 6 | 0.110% | 0.3 | 7 | 34 |
| 42 | 0.9 | A | 5 | 0.130% | 0.3 | 5 | 35 |
| 43 | 1.0 | A | 4 | 0.120% | 0.3 | 10 | 36 |
| 44 | 1.1 | A | 5 | 0.100% | 0.3 | 9 | 37 |
| 45 | 1.2 | A | 5 | 0.110% | 0.2 | 8 | 38 |
| 46 | 1.1 | A | 4 | 0.130% | 0.3 | 9 | 39 |
| 47 | 1.0 | A | 5 | 0.140% | 0.3 | 6 | 40 |
| 48 | 1.1 | A | 6 | 0.100% | 0.2 | 10 | 41 |
| 49 | 1.1 | A | 5 | 0.130% | 0.1 | 6 | 42 |
| 50 | 1.1 | A | 5 | 0.150% | 0.3 | 9 | 43 |
| 51 | 1.4 | A | 4 | 0.130% | 0.4 | 6 | 44 |
| 52 | 0.7 | A | 9 | 0.110% | 0.1 | 15 | 45 |
| 53 | 1.0 | A | 7 | 0.120% | 0.2 | 6 | 46 |
| 54 | 1.0 | A | 6 | 0.100% | 0.2 | 8 | 47 |
| 55 | 1.2 | A | 5 | 0.020% | 0.1 | 8 | 34 |
| 56 | 1.1 | A | 5 | 0.150% | 0.2 | 8 | 34 |
| 57 | 1.0 | A | 6 | 0.120% | 0.2 | 7 | 48 |
| 58 | 1.0 | A | 5 | 0.090% | 0.3 | 8 | 34 |
| 59 | 1.0 | A | 5 | 0.100% | 0.3 | 8 | 34 |
| 60 | 1.1 | A | 6 | 0.120% | 0.2 | 7 | 34 |
| 61 | 0.9 | A | 5 | 0.100% | 0.4 | 8 | 34 |
| 62 | 1.0 | A | 6 | 0.090% | 0.3 | 7 | 34 |
| 63 | 1.0 | A | 5 | 0.100% | 0.2 | 10 | 34 |

TABLE 26-continued

| Example | Kinetic friction coefficient | Ghost image | Ghost electric potential (V) | β content (% by mass) | Relative to comparative example: Decrease in kinetic friction coefficient | Decrease in ghost potential | Corresponding comparative example |
|---|---|---|---|---|---|---|---|
| 64 | 0.9 | A | 5 | 0.110% | 0.3 | 7 | 34 |
| 65 | 1.0 | A | 6 | 0.160% | 0.2 | 6 | 34 |
| 66 | 1.8 | A | 4 | 0.110% | 0.2 | 4 | 52 |
| 67 | 0.7 | A | 7 | 0.110% | 0.1 | 15 | 53 |
| 68 | 1.0 | A | 5 | 0.110% | 0.3 | 11 | 54 |
| 69 | 1.0 | A | 5 | 0.100% | 0.2 | 9 | 55 |
| 70 | 1.1 | A | 5 | 0.130% | 0.2 | 11 | 56 |
| 71 | 1.0 | B | 11 | 0.001% | 0.2 | 3 | 57 |
| 72 | 1.0 | A | 3 | 2.000% | 0.3 | 11 | 58 |

15

TABLE 27

| Example | Kinetic friction coefficient | Ghost image | Ghost electric potential (V) | β content (% by mass) | Relative to comparative example: Decrease in kinetic friction coefficient | Decrease in ghost potential | Corresponding comparative example |
|---|---|---|---|---|---|---|---|
| 73 | 1.0 | A | 5 | 0.110% | 0.3 | 6 | 59 |
| 74 | 1.0 | A | 4 | 0.140% | 0.2 | 10 | 60 |
| 75 | 1.0 | A | 5 | 0.100% | 0.3 | 7 | 61 |
| 76 | 0.9 | A | 6 | 0.110% | 0.2 | 8 | 62 |
| 77 | 1.0 | A | 4 | 0.140% | 0.3 | 8 | 63 |
| 78 | 1.0 | A | 5 | 0.120% | 0.3 | 6 | 64 |
| 79 | 1.1 | A | 6 | 0.110% | 0.3 | 7 | 65 |
| 80 | 1.4 | A | 4 | 0.130% | 0.4 | 6 | 66 |
| 81 | 0.7 | B | 11 | 0.110% | 0.1 | 12 | 67 |
| 82 | 1.0 | A | 4 | 0.120% | 0.2 | 7 | 68 |
| 83 | 0.9 | A | 4 | 0.100% | 0.3 | 9 | 69 |
| 84 | 1.2 | A | 6 | 0.010% | 0.1 | 5 | 59 |
| 85 | 1.1 | A | 4 | 0.200% | 0.2 | 7 | 59 |
| 86 | 1.0 | A | 4 | 0.300% | 0.3 | 7 | 59 |
| 87 | 1.1 | A | 5 | 0.120% | 0.2 | 6 | 70 |
| 88 | 1.0 | A | 5 | 0.090% | 0.3 | 6 | 59 |
| 89 | 0.9 | A | 4 | 0.120% | 0.4 | 7 | 59 |
| 90 | 0.9 | A | 4 | 0.130% | 0.4 | 7 | 59 |
| 91 | 1.0 | A | 4 | 0.120% | 0.3 | 7 | 59 |
| 92 | 1.0 | A | 5 | 0.090% | 0.3 | 6 | 59 |
| 93 | 0.9 | A | 5 | 0.120% | 0.4 | 6 | 59 |
| 94 | 1.0 | A | 5 | 0.170% | 0.3 | 6 | 59 |
| 95 | 0.9 | A | 4 | 0.200% | 0.4 | 7 | 59 |
| 96 | 1.1 | B | 8 | 0.070% | 0.2 | 3 | 59 |
| 97 | 1.2 | A | 7 | 0.800% | 0.1 | 4 | 59 |
| 98 | 1.1 | B | 9 | 0.110% | 0.2 | 2 | 59 |

TABLE 28

| Example | Kinetic friction coefficient | Ghost image | Ghost electric potential (V) | β content (% by mass) | Relative to comparative example: Decrease in kinetic friction coefficient | Decrease in ghost potential | Corresponding comparative example |
|---|---|---|---|---|---|---|---|
| 99 | 1.1 | B | 9 | 0.140% | 0.2 | 2 | 59 |
| 100 | 1.2 | A | 7 | 0.150% | 0.1 | 4 | 59 |
| 101 | 1.1 | B | 9 | 0.150% | 0.2 | 2 | 59 |
| 102 | 1.0 | B | 10 | 0.090% | 0.3 | 1 | 59 |
| 103 | 1.1 | A | 5 | 0.170% | 0.2 | 6 | 59 |
| 104 | 1.1 | A | 5 | 0.140% | 0.2 | 6 | 59 |
| 105 | 1.1 | A | 6 | 0.130% | 0.2 | 5 | 59 |
| 106 | 0.9 | B | 10 | 0.160% | 0.4 | 1 | 59 |
| 107 | 1.1 | A | 6 | 0.150% | 0.2 | 5 | 59 |
| 108 | 1.2 | A | 7 | 0.190% | 0.1 | 4 | 59 |
| 109 | 1.7 | A | 4 | 0.110% | 0.2 | 5 | 74 |
| 110 | 0.7 | A | 7 | 0.120% | 0.3 | 13 | 75 |
| 111 | 1.0 | A | 6 | 0.110% | 0.3 | 10 | 76 |
| 112 | 1.0 | A | 5 | 0.110% | 0.2 | 7 | 77 |
| 113 | 1.0 | A | 5 | 0.110% | 0.2 | 7 | 78 |

TABLE 28-continued

| Example | Kinetic friction coefficient | Ghost image | Ghost electric potential (V) | β content (% by mass) | Relative to comparative example: Decrease in kinetic friction coefficient | Decrease in ghost potential | Corresponding comparative example |
|---|---|---|---|---|---|---|---|
| 114 | 1.0 | A | 6 | 0.110% | 0.2 | 9 | 79 |
| 115 | 1.0 | A | 5 | 0.110% | 0.2 | 7 | 80 |
| 116 | 1.0 | A | 4 | 0.110% | 0.2 | 8 | 81 |
| 117 | 1.1 | A | 5 | 0.900% | 0.2 | 6 | 82 |
| 118 | 1.2 | A | 5 | 0.800% | 0.2 | 6 | 83 |
| 119 | 0.9 | A | 5 | 0.090% | 0.2 | 6 | 84 |
| 120 | 1.1 | A | 6 | 0.130% | 0.2 | 9 | 85 |
| 121 | 1.0 | B | 10 | 0.001% | 0.2 | 2 | 86 |
| 122 | 1.0 | A | 3 | 2.000% | 0.2 | 11 | 87 |
| 123 | 1.0 | A | 3 | 3.000% | 0.2 | 10 | 88 |
| 124 | 1.0 | A | 5 | 0.120% | 0.3 | 6 | 59 |
| 125 | 1.0 | A | 5 | 0.090% | 0.3 | 6 | 59 |

TABLE 29

| Example | Kinetic friction coefficient | Ghost image | Ghost electric potential (V) | β content (% by mass) | Relative to comparative example: Decrease in kinetic friction coefficient | Decrease in ghost potential | Corresponding comparative example |
|---|---|---|---|---|---|---|---|
| 126 | 1.0 | A | 5 | 0.110% | 0.2 | 6 | 89 |
| 127 | 1.0 | A | 4 | 0.120% | 0.3 | 7 | 90 |
| 128 | 1.1 | A | 5 | 0.110% | 0.2 | 6 | 91 |
| 129 | 1.0 | A | 4 | 0.110% | 0.3 | 5 | 92 |
| 130 | 1.1 | A | 5 | 0.110% | 0.3 | 5 | 93 |
| 131 | 1.2 | A | 5 | 0.110% | 0.2 | 6 | 94 |
| 132 | 1.1 | A | 5 | 0.100% | 0.3 | 8 | 95 |
| 133 | 1.0 | A | 5 | 0.120% | 0.2 | 9 | 96 |
| 134 | 1.4 | A | 3 | 0.100% | 0.4 | 4 | 97 |
| 135 | 0.7 | B | 11 | 0.120% | 0.1 | 13 | 98 |
| 136 | 1.1 | A | 6 | 0.100% | 0.1 | 7 | 99 |
| 137 | 1.0 | A | 5 | 0.100% | 0.3 | 6 | 100 |
| 138 | 1.0 | A | 5 | 0.130% | 0.2 | 8 | 101 |
| 139 | 1.1 | A | 5 | 0.030% | 0.1 | 6 | 89 |
| 140 | 1.0 | A | 4 | 0.160% | 0.2 | 7 | 89 |
| 141 | 1.0 | A | 5 | 0.120% | 0.2 | 4 | 102 |
| 142 | 0.9 | A | 6 | 0.100% | 0.3 | 5 | 89 |
| 143 | 1.0 | A | 4 | 0.110% | 0.2 | 7 | 89 |
| 144 | 1.1 | A | 5 | 0.120% | 0.1 | 6 | 89 |
| 145 | 1.1 | A | 6 | 0.100% | 0.1 | 5 | 89 |
| 146 | 1.0 | A | 6 | 0.100% | 0.2 | 5 | 89 |
| 147 | 1.0 | A | 6 | 0.100% | 0.3 | 5 | 89 |
| 148 | 1.2 | A | 5 | 0.110% | 0.1 | 6 | 89 |
| 149 | 0.9 | A | 5 | 0.150% | 0.4 | 8 | 89 |
| 150 | 1.8 | A | 3 | 0.110% | 0.1 | 5 | 106 |
| 151 | 0.7 | B | 8 | 0.110% | 0.1 | 15 | 107 |
| 152 | 1.0 | A | 6 | 0.110% | 0.2 | 8 | 108 |
| 153 | 1.0 | A | 5 | 0.100% | 0.2 | 6 | 109 |
| 154 | 1.0 | A | 6 | 0.120% | 0.3 | 8 | 110 |
| 155 | 1.0 | B | 9 | 0.001% | 0.3 | 3 | 111 |
| 156 | 1.0 | A | 3 | 2.000% | 0.2 | 11 | 112 |

TABLE 30

| Comparative Example | Kinetic friction coefficient | Ghost image | Ghost electric potential (V) |
|---|---|---|---|
| 1 | 1.2 | C | 15 |
| 2 | 1.3 | B | 10 |
| 3 | 1.2 | B | 10 |
| 4 | 1.4 | C | 15 |
| 5 | 1.3 | B | 10 |
| 6 | 1.2 | B | 12 |
| 7 | 1.2 | B | 14 |
| 8 | 1.4 | B | 12 |
| 9 | 1.0 | B | 10 |
| 10 | 1.3 | B | 14 |

TABLE 30-continued

| Comparative Example | Kinetic friction coefficient | Ghost image | Ghost electric potential (V) |
|---|---|---|---|
| 11 | 1.1 | C | 15 |
| 12 | 1.3 | B | 10 |
| 13 | 1.1 | B | 14 |
| 14 | 1.3 | B | 12 |
| 15 | 1.8 | B | 9 |
| 16 | 0.8 | C | 22 |
| 17 | 1.1 | B | 10 |
| 18 | 1.1 | B | 11 |
| 19 | 1.2 | B | 10 |
| 20 | 1.2 | B | 13 |

TABLE 30-continued

| Comparative Example | Kinetic friction coefficient | Ghost image | Ghost electric potential (V) |
|---|---|---|---|
| 21 | 1.2 | B | 10 |
| 22 | 1.1 | B | 11 |
| 23 | 2.0 | A | 7 |
| 24 | 1.0 | C | 20 |
| 25 | 1.1 | C | 15 |
| 26 | 1.1 | B | 14 |
| 27 | 1.1 | C | 15 |
| 28 | 1.1 | B | 14 |
| 29 | 1.2 | B | 10 |
| 30 | 1.1 | B | 11 |
| 31 | 1.1 | B | 8 |
| 32 | 1.3 | C | 16 |
| 33 | 1.3 | B | 14 |
| 34 | 1.3 | B | 13 |
| 35 | 1.2 | B | 10 |
| 36 | 1.3 | B | 14 |
| 37 | 1.4 | B | 14 |
| 38 | 1.4 | B | 13 |
| 39 | 1.4 | B | 13 |
| 40 | 1.3 | B | 11 |
| 41 | 1.3 | C | 16 |
| 42 | 1.2 | B | 11 |
| 43 | 1.4 | B | 14 |
| 44 | 1.8 | B | 10 |
| 45 | 0.8 | C | 24 |
| 46 | 1.2 | B | 13 |
| 47 | 1.2 | B | 14 |
| 48 | 1.2 | B | 13 |
| 49 | 1.2 | C | 15 |
| 50 | 1.2 | B | 12 |
| 51 | 1.2 | B | 12 |
| 52 | 2.0 | B | 8 |
| 53 | 0.8 | C | 22 |
| 54 | 1.3 | C | 16 |
| 55 | 1.2 | B | 14 |
| 56 | 1.3 | C | 16 |
| 57 | 1.2 | B | 14 |
| 58 | 1.3 | B | 14 |

TABLE 31

| Comparative Example | Kinetic friction coefficient | Ghost image | Ghost electric potential (V) |
|---|---|---|---|
| 59 | 1.3 | B | 11 |
| 60 | 1.2 | B | 14 |
| 61 | 1.3 | B | 12 |
| 62 | 1.1 | B | 14 |
| 63 | 1.3 | B | 12 |
| 64 | 1.3 | B | 11 |
| 65 | 1.4 | B | 13 |
| 66 | 1.8 | B | 10 |
| 67 | 0.8 | C | 23 |
| 68 | 1.2 | B | 11 |
| 69 | 1.2 | B | 13 |
| 70 | 1.3 | B | 11 |
| 71 | 1.2 | B | 11 |
| 72 | 1.2 | B | 11 |
| 73 | 1.1 | B | 10 |
| 74 | 1.9 | B | 9 |
| 75 | 1.0 | C | 20 |
| 76 | 1.3 | C | 16 |
| 77 | 1.2 | B | 12 |
| 78 | 1.2 | B | 12 |
| 79 | 1.2 | C | 15 |
| 80 | 1.2 | B | 12 |
| 81 | 1.2 | B | 12 |
| 82 | 1.3 | B | 11 |
| 83 | 1.4 | B | 11 |
| 84 | 1.1 | B | 11 |
| 85 | 1.3 | C | 15 |
| 86 | 1.2 | B | 12 |

TABLE 31-continued

| Comparative Example | Kinetic friction coefficient | Ghost image | Ghost electric potential (V) |
|---|---|---|---|
| 87 | 1.2 | B | 14 |
| 88 | 1.2 | B | 13 |
| 89 | 1.2 | B | 11 |
| 90 | 1.3 | B | 11 |
| 91 | 1.3 | B | 11 |
| 92 | 1.3 | B | 9 |
| 93 | 1.4 | B | 10 |
| 94 | 1.4 | B | 11 |
| 95 | 1.4 | B | 13 |
| 96 | 1.2 | B | 14 |
| 97 | 1.8 | A | 7 |
| 98 | 0.8 | C | 24 |
| 99 | 1.2 | B | 13 |
| 100 | 1.3 | B | 11 |
| 101 | 1.2 | B | 13 |
| 102 | 1.2 | B | 9 |
| 103 | 1.3 | B | 11 |
| 104 | 1.3 | B | 11 |
| 105 | 1.3 | B | 13 |
| 106 | 1.9 | B | 8 |
| 107 | 0.8 | C | 23 |
| 108 | 1.2 | B | 14 |
| 109 | 1.2 | B | 11 |
| 110 | 1.3 | B | 14 |
| 111 | 1.3 | B | 12 |
| 112 | 1.2 | B | 14 |

Comparison of the examples and the comparative examples shows that the siloxane-modified resin of the constituent α and the compound of the constituent β in the surface layer of the electrophotographic photosensitive member can reduce the initial friction coefficient and occurrence of ghost images during repeated use of the electrophotographic photosensitive member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-250513 filed Nov. 14, 2012 and No. 2013-214108, filed Oct. 11, 2013, which are hereby incorporated by reference herein in their entirety.

What is claimed is:

1. An cylindrical electrophotographic photosensitive member comprising:

a support;

a charge generating layer formed on the support; and a charge transporting layer formed on the charge generating layer;

wherein a surface layer of the electrophotographic photosensitive member comprises the following (α), (β) and a charge transporting substance:

(α) a siloxane-modified resin having a structural unit represented by any one of the following formulae (A), (B), (C) and (D);

(β) at least one compound selected from the group consisting of cyclohexanol, benzyl alcohol, methyl benzoate, benzyl acetate, ethyl 3-ethoxypropionate, acetophenone, and methyl salicate;

wherein the (β) content ranges from 0.0001% to 2.0% by mass of the total mass of the surface layer, (A)

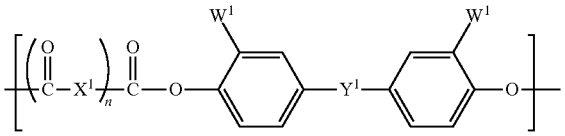

wherein, in the formula (A), $Y^1$ represents a single bond, a methylene group, an ethylidene group, a propylidene group, a phenylethylidene group, a cyclohexylidene group, or an oxygen atom, $X^1$ represents a meta-phenylene group, a para-phenylene group, or a bivalent group having two para-phenylene groups bonded with an oxygen atom, n represents 0 or 1, $W^1$ represents a univalent group represented by the following formula (W1) or (W2), (W1)

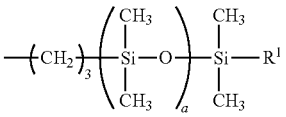

(W2)

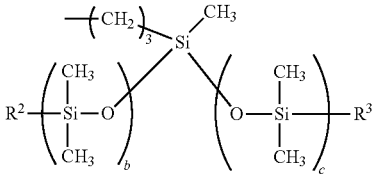

wherein, in the formulae (W1) and (W2), $R^1$ to $R^3$ each independently represents an alkyl group having 1 to 4 carbon atoms, a represents the number of repetitions of a structure in parentheses, b and c each independently represents the number of repetitions of a structure in parentheses, the average of a in the siloxane-modified resin having a structural unit represented by the formula (A) ranges from 10 to 150, the average of b+c therein ranges from 10 to 150, (B)

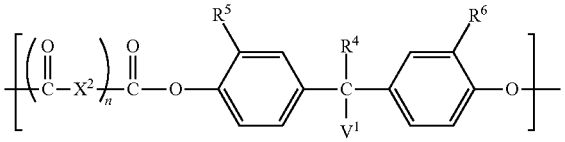

wherein, in the formula (B), $X^2$ represents a meta-phenylene group, a para-phenylene group, or a bivalent group having two para-phenylene groups bonded with an oxygen atom, $R^4$ to $R^6$ each independently represents a hydrogen atom, an alkyl group having 1 to 4 carbon atoms, or a phenyl group, n represents 0 or 1, $V^1$ represents a univalent group represented by the following formula (V1) or (V2), (V1)

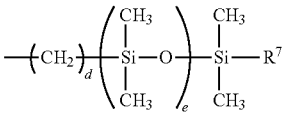

(V2)

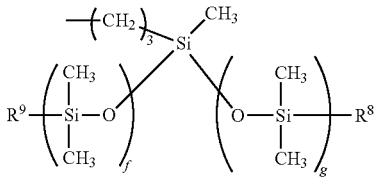

wherein, in the formulae (V1) and (V2), $R^7$ to $R^9$ each independently represents an alkyl group having 1 to 4 carbon atoms, d represents an integer from 2 to 10, e represents the number of repetitions of a structure in parentheses, f and g each independently represents the number of repetitions of a structure in parentheses, the average of e in the siloxane-modified resin having a structural unit represented by the formula (B) ranges from 10 to 150, the average of f+g therein ranges from 10 to 150, (C)

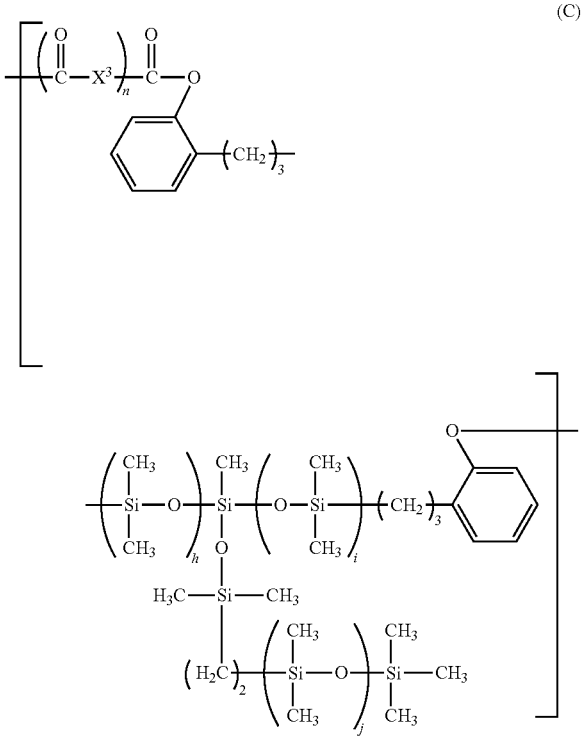

wherein, in the formula (C), $X^3$ represents a meta-phenylene group, a para-phenylene group, or a bivalent group having two para-phenylene groups bonded with an oxygen atom, n represents 0 or 1, h, i, and j each independently represents the number of repetitions of a structure in parentheses, the average of h in the siloxane-modified resin having a structural unit represented by the formula (C) and the average of i therein each independently ranges from 1 to 10, and the average of j therein ranges from 20 to 200, (D)

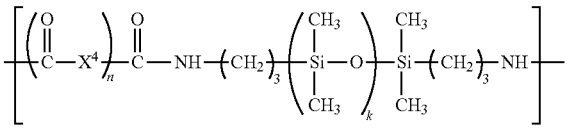

wherein, in the formula (D), $X^4$ represents a meta-phenylene group, a para-phenylene group, or a bivalent group having two para-phenylene groups bonded with an oxygen atom, n represents 0 or 1, and k represents the number of repetitions of a structure in parentheses, and the average of k in the siloxane-modified resin having a structural unit represented by the formula (D) ranges from 20 to 200.

2. The electrophotographic photosensitive member according to claim 1, wherein the (α) content ranges from 1% to 45% by mass of the total mass of the surface layer.

3. The electrophotographic photosensitive member according to claim 1, wherein the siloxane-modified resin further has a structural unit represented by the following formula (E):

(E)

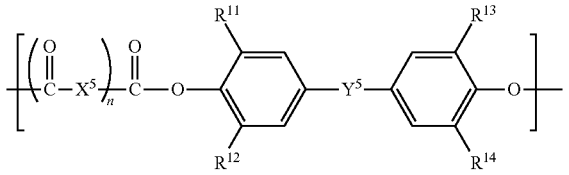

wherein, in the formula (E), $Y^5$ represents a single bond, a methylene group, an ethylidene group, a propylidene group, a phenylethylidene group, a cyclohexylidene group, or an oxygen atom, $X^5$ represents a meta-phenylene group, a para-phenylene group, or a bivalent group having two para-phenylene groups bonded with an oxygen atom, n represents 0 or 1, and $R^{11}$ to $R^{14}$ each independently represents a hydrogen atom or an alkyl group having 1 to 4 carbon atoms.

4. The electrophotographic photosensitive member according to claim 1, wherein the charge transporting substance is at least one selected from the group consisting of triarylamine compounds, hydrazone compounds, styryl compounds, stilbene compounds, and enamine compounds.

5. The electrophotographic photosensitive member according to claim 1, wherein the surface layer is the charge transporting layer.

6. The electrophotographic photosensitive member according to claim 1, wherein the siloxane moiety content of the siloxane-modified resin ranges from 1% to 50% by mass of the total mass of the siloxane-modified resin.

7. The electrophotographic photosensitive member according to claim 1, wherein the charge transporting substance content ranges from 20% to 50% by mass of the total mass of the surface layer.

8. A process cartridge detachably attachable to a main body of an electrophotographic apparatus, wherein the process cartridge integrally supports:

the electrophotographic photosensitive member according to claim 1, and at least one unit selected from the group consisting of a charging unit, a developing unit, a transferring unit, and a cleaning unit.

9. An electrophotographic apparatus, comprising: the electrophotographic photosensitive member according to claim 1; a charging unit; an exposure unit; a developing unit; and a transferring unit.

* * * * *